US005135410A

United States Patent [19]

Kawase et al.

[11] Patent Number: 5,135,410

[45] Date of Patent: Aug. 4, 1992

[54] ELECTRIC CONNECTOR ASSEMBLY

[75] Inventors: Hajime Kawase; Shozo Hamakita, both of Suzuka, Japan

[73] Assignee: Sumitomo Wiring Systems, Ltd., Mie, Japan

[21] Appl. No.: 706,609

[22] Filed: May 28, 1991

[30] Foreign Application Priority Data

| | | | |
|---|---|---|---|
| May 30, 1990 | [JP] | Japan | 2-57034[U] |
| Jun. 20, 1990 | [JP] | Japan | 2-162314 |
| Jun. 29, 1990 | [JP] | Japan | 2-70115[U] |
| Jun. 29, 1990 | [JP] | Japan | 2-174027 |

[51] Int. Cl.[5] ..... H01R 13/62

[52] U.S. Cl. ..... 439/372; 439/157; 439/489

[58] Field of Search ..... 439/152–160, 439/341, 372, 488, 489; 361/413–415

[56] References Cited

U.S. PATENT DOCUMENTS

| | | | |
|---|---|---|---|
| 2,939,103 | 5/1960 | Agron et al. | 439/157 |
| 2,987,693 | 6/1961 | Wamsley | 439/157 |
| 3,300,751 | 1/1967 | Fraley | 439/372 |
| 3,784,954 | 1/1974 | Grimm et al. | 439/160 |

FOREIGN PATENT DOCUMENTS

| | | | |
|---|---|---|---|
| 2179506 | 3/1987 | United Kingdom | 439/372 |

*Primary Examiner*—David L. Pirlot

*Attorney, Agent, or Firm*—Sughrue, Mion, Zinn, Macpeak & Seas

[57] ABSTRACT

A connector assembly comprises first and second connector housings having first and second terminal elements, respectively, adapted to be electrically connected with each other when the first and second connector housings are completely coupled with each other. The first housing has a pair of engagement pins on respective sides thereof while a lock handle having a pair of arms is mounted on the second housing for rotation between release and locked position. A free end portion of each of the arms is formed with a generally arcuate guide path along which the associated engagement pin slides, as the lock handle is rotated from the release position towards the locked position, so that the first housing can be positively drawn close towards the second housing thereby to connect the first and second terminal elements together. The arcuate guide path defined in each of the arms is delimited by long and short cam edges opposite to each other and between leading and trailing ends thereof. To minimize a friction which occurs between each engagement pin and one of the long and short cam edges during the rotation of the lock handle, each engagement pin is provided with a friction reducing element. The connector assembly may also comprises a detector for detecting a complete electric connection between the first and second terminal elements upon arrival of the lock handle at the locked position.

9 Claims, 11 Drawing Sheets

ELECTRIC CONNECTOR ASSEMBLY

BACKGROUND OF THE INVENTION

1. Field of the Invention

The present invention generally relates to a connector assembly comprising male and female connectors adapted to be connected together and, more particularly, to a lock mechanism used in the connector assembly to facilitate a connection between the male and female connectors and also to lock one of the male and female connectors in a condition firmly connected with the other of the male and female connectors.

2. Description of the Prior Art

In an automobile, for example, electric wires used to distribute electric power among numerous electrically operated devices are bound together into harnesses. Those electric wires bound together into the harnesses are generally known as wiring harnesses and are generally marked by means of colors for identification purpose. The electric wires forming the wiring harness may lead out from an electrically operated device and terminate in a terminal connector for connection with a different electrically operated device through another similar wiring harness having a mating terminal connector at its opposite ends.

In the case of harness-to-harness connection, it is a general practice to employ a plug-in connector assembly comprising a plug connector including a number of terminal pins and a socket connector including a corresponding number of terminal sockets for receiving the terminal pins. To connect the plug-in and socket connectors together to establish electric circuits between the electric wires terminating in the plug connector and the electric wires terminating in the socket connector, a pushing force must be applied to one of the connectors, while the other of the connectors is held stationary, so that such one of the connectors can be urged to the other of the connectors with the terminal pins inserted into the associated terminal sockets.

It has hitherto been experienced that the greater the number of the terminal pins, the larger is the pushing force required to complete the connection.

In order to minimize the pushing force required to accomplish the firm connection between the plug and socket connectors, the use has been made of a lever mechanism designed to facilitate a draw of one of the connectors close towards the other of the connector and also to lock the connectors in a connected position, such as disclosed in, for example, the Japanese Laid-open Patent Publication No. 55-80282 published Jun. 17, 1980, and the Japanese Laid-open Patent Publication No. 2-56875 published Feb. 26, 1990.

The lever mechanism disclosed in the first mentioned publication comprises a generally tubular operating member comprised of top and bottom walls and a pair of opposite side walls and mounted on one of the plug and socket connectors, for example, the plug connector. Each of the side walls of the operating member is formed with a pair of guide grooves cooperable with guide pins formed on each side wall of the socket connector, said guide pins being so defined and so positioned that, when the plug and socket connectors are aligned with each other in readiness for insertion of one of the connectors into the other of the connectors, the guide pins can be received in the associated guide grooves.

The guide grooves defined in the operating member are so defined and so shaped that, when the operating member is pushed to displace towards a locked position in a direction transverse to the direction of insertion of one of the plug and socket connectors into the other of the plug and socket connectors after the plug and socket connectors are aligned with each other with the guide pins received in the associated guide grooves, the guide pins can be guided deep into the associated guide grooves while the socket connector is forcibly drawn close towards the plug connector and, at the time of completion of the movement of the operating member to the locked position, the plug and socket connectors can be connected together with the terminal pins firmly inserted into the respective terminal sockets.

In this prior art lever mechanism, each of the guide grooves defined in the operating member is comprised of a straight groove portion extending generally parallel to the direction of insertion of the plug connector into the socket connector and a slant groove portion continued from the straight groove portion and extending generally diagonally relative to the direction of movement of the operating member which is transverse to the direction of insertion.

The above discussed prior art lever mechanism has been found having the following problems. In the first place, although the force necessary to push the operating member towards the locked position thereby to accomplish the complete insertion of one of the plug and socket connectors into the other of the plug and socket connectors is smaller than the force necessary to push one of the plug and socket connectors relative to the other of the plug and socket connector to accomplish the same effect, the force necessary to push the operating member is not always uniform throughout the entire stroke of movement of the operating member from a release position to the locked position and a progressively increasing force is required as one of the plug and socket connectors is drawn closer towards the other of the plug and socket connectors.

In addition, once the operating member has been moved to the locked position, the bottom wall of the operating member remains projecting a distance outwardly from a bottom of the connector assembly. This is because the top and bottom walls of the operating member movable from the release position towards the locked position must be spaced a distance greater than the thickness of the connector assembly so that the top wall of the operating member spaced a distance outwardly from the top of the connector assembly prior to the movement of the operating member from the release position towards the locked position can be held in contact with the top of the connector assembly after the operating member has been moved to the locked position. Therefore, in the event that an external force acts on the bottom wall of the operating member by some reason, the operating member may be moved from the locked position towards the release position allowing one of the plug and socket connectors to be accidentally separated away from the other of the plug and socket connectors.

The second mentioned publication, that is, the JP Laid-open Patent Publication No. 2-56875, discloses the use of the lever mechanism employed in the form of a generally U-shaped lock handle supported for pivotal movement between release and locked positions spaced angularly from each other about an axis of rotation of the lock handle. The generally U-shaped lock handle includes a handle bar and a pair of generally L-shaped arms connected at one ends with opposite ends of the handle bar. This U-shaped lock handle is mounted on, for example, the plug connector having its opposite side walls provided with coaxial bearing pins onto which respective free ends of the arms of the lock handle are rotatably mounted. The lock handle is pivotable between the release position, in which the arms of the lock handle extend diagonally upwardly in a direction opposite to the socket connector with the handle bar positioned spaced a distance upwardly from a top of the plug connector, and the locked position in which the arms of the lock handle extend generally parallel to the direction of insertion of the plug connector into the socket connector with the handle bar resting on the top of the plug connector.

The plug connector has its opposite side walls formed with respective recesses for receiving therein associated guide pins formed on corresponding side walls of the socket connector. In order for the guide pins on the side walls of the socket connector to be engaged in the respective recesses in the side walls of the plug connector to accomplish the firm connection between the plug and socket connectors, curved cam flanges are formed on the respective free ends of the arms of the lock handle. These cam flanges are so shaped and so configured that, when the lock handle is pivoted from the release position towards the locked position after the plug and socket connectors have been mated with each other, leading ends of the respective cam flanges with respect to the direction of angular movement of the lock handle towards the locked position enter behind the guide pins so as to encompass the associated guide pins and the continued angular movement of the lock handle can cause the cam flanges to draw the associated guide pins close towards the plug connector so as to enter the respective recesses in the side walls of the plug connector.

The lever mechanism disclosed in the second mentioned publication also comprises a lock means for locking the lock handle in the locked position, which means comprises a pair of detent projections protruding outwardly from the respective side wall of the plug connector and detent holes defined in the respective arms of the lock handle. When the lock handle is pivoted to the locked position, the detent projections engage in the associated detent holes to lock the lock handle in the locked position.

While the plug-in connector assembly according to the second mentioned publication operates satisfactorily, it requires a visual inspection to ascertain whether or not the lock handle has been moved to the locked position and, hence, whether or not the plug terminals have been electrically completely connected with the socket terminals.

SUMMARY OF THE INVENTION

The present invention is intended to provide an improved connector assembly capable of ensuring a complete and reliable electric connection between first terminal elements in one connector housing and second terminal elements in a mating connector housing when the connector housings are mechanically connected together with an application of a minimized force to a lock handle to rotate the latter from a release position towards a locked position.

Another object of the present invention is to provide an improved connector assembly of the type referred to above, which does not require any visual inspection to ascertain whether or not the lock handle has been moved to the locked position and, hence, whether or not the first and second terminal elements have been electrically completely connected together.

A further object of the present invention is to provide an improved connector assembly of the type referred to above, which is effective to avoid any possible separation of any one of arms of a lock handle from its associated bearing pins.

A still further object of the present invention is to provide an improved connector assembly of the type referred to above, wherein the force required to rotate the lock handle from the release position towards the locked position can be advantageously minimized to facilitate an easy and ready connection of the first and second connector housings.

In order to accomplish these objects of the present invention, there is provided a connector assembly which comprises a first connector housing having a plurality of first electric terminal elements; a second connector housing having a corresponding number of second electric terminal elements adapted to be electrically connected with the first electric terminal elements when the first and second connector housings are connected together; a pair of engagement pin members mounted on the first connector housing so as to protrude outwardly therefrom and positioned on respective sides of the first connector housing; and a lock handle having a pair of spaced apart arms and a handle bar connected at opposite ends with the arms. The lock handle also has an axis of rotation thereof substantially perpendicular to each of the arms and is angularly displaceably mounted on the second connector housing with the arms positioned on respective sides thereof for rotation between a release position, in which the first and second connector housings are separated from each other, and a locked position in which the first and second connector housings are connected together with the first terminal elements electrically completely connected with the second terminal elements.

The connector assembly also comprises a shaped cam means defined in a free end portion of each of the arms and cooperable with the corresponding engagement pin member, said shaped cam means being of a generally arcuate shape having a center of curvature which is located offset from the axis of rotation of the lock handle whereby, as the lock handle is rotated from the release position towards the locked position after the first and second connector housings have been aligned with each other, the corresponding engagement pin member is guided along the shaped cam means allowing the first connector housing to be drawn relative to and close towards the second connector housing thereby to accomplish a complete electric connection between the first and second terminal elements upon arrival of the lock handle at the locked position. Each of the engagement pin members has a friction-reducing element to facilitate a relative movement of the respective engagement pin member along the shaped cam means during the rotation of the lock handle between the release and locked positions.

Preferably, the shaped cam means comprises a generally arcuate guide slot or groove defined in the free end portion of each of the arms of the lock handle and having leading and trailing ends with respect to the direction of rotation of the lock handle from the release position towards the locked position. This arcuate guide slot or groove is delimited by long and short cam edges opposite to and spaced a predetermined distance from each other and between the leading and trailing ends. Where the guide slot or groove is employed in each of the arms of the lock handle, an area of the free end of each arm adjacent the leading end of the arcuate guide slot or groove has a straight guide slot or groove defined therein for receipt of and guiding the associated engagement pin member into the leading end of the arcuate guide slot when the first and second connector housings are brought into abutment with each other while the lock handle is held in the release position.

Preferably, each of the engagement pin members comprises a shank portion connected at one end to the first connector housing and the opposite end formed with a radially outwardly extending head and wherein the friction-reducing element comprises a generally tubular member rotatably mounted on the shank of the respective engagement pin member.

If desired, the connector assembly may further comprising a detecting means for detecting a complete arrival of the lock handle to the locked position and for providing an indication that, consequent upon the complete arrival of the lock handle at the locked position, the first and second terminal members are electrically completely connected together.

Again, preferably, the arcuate guide groove may be of a generally T-shaped cross-sectional shape and wherein each of the engagement pin members comprises a shank portion connected at one end to the first connector housing and the opposite end formed with a radially outwardly extending head so as to represent a generally T-shaped configuration complemental to the cross-sectional shape of the arcuate guide groove.

The connector assembly may have a temporary retaining means for retaining the lock handle at the release position thereby to avoid an arbitrary motion of the lock handle about the axis of rotation thereof.

BRIEF DESCRIPTION OF THE DRAWINGS

These and other objects and features of the present invention will become clear from the following description taken in conjunction with preferred embodiments thereof with reference to the accompanying drawings, in which.

DETAILED DESCRIPTION OF THE EMBODIMENTS

Figure 1:
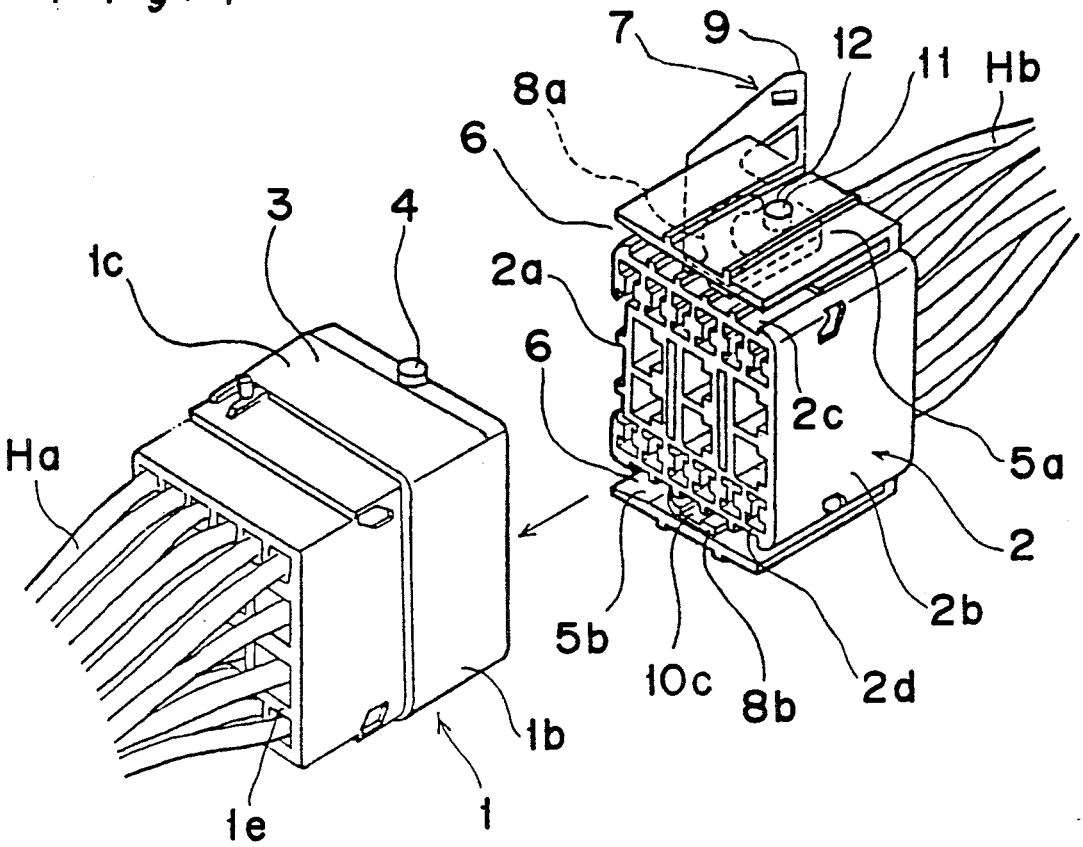
FIG. 1 is a perspective view of a harness connector assembly according to a first preferred embodiment of the present invention, showing plug and socket connectors separated from each other.
Figure 2:
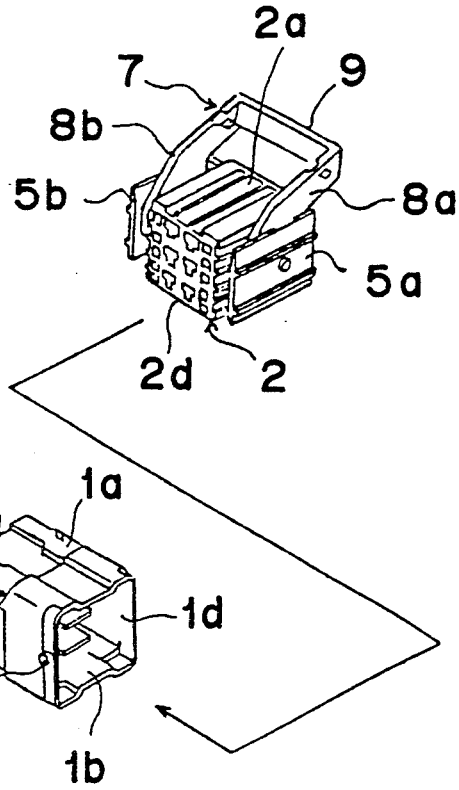
FIG. 2 is a perspective view, on a somewhat reduced scale, of the harness connector assembly of FIG. 1, as viewed from different angles.

Before the description of some preferred embodiments of the present invention proceeds, it is to be noted that like parts are designated by like reference numerals throughout the accompanying drawings.

Referring first to FIGS. 1 to 12 showing a first preferred embodiment of the present invention, a harness connector assembly shown therein generally comprises a plug connector and a mating socket connector adapted to be connected with the plug connector to complete the connector assembly. The plug connector includes a plug connector housing 1 of generally rectangular cubic configuration accommodating therein a plurality of plug terminals arranged in a predetermined pattern while the socket connector includes a connector includes a socket connector housing 2 of a configuration substantially similar to that of the plug connector housing 1 and accommodating therein a corresponding number of socket terminals arranged in a pattern similar to that of the plug terminals in the plug connector housing 1, said socket terminals being adapted to receive therein the corresponding plug terminals when and after the plug connector has been inserted into the socket connector housing 2 in a manner as will be described later.

The plug connector housing 1 includes a top wall 1*a*, a bottom wall 1*b*, a pair of side walls 1*c* and 1*d* and an end wall l*e*, all assembled together to render the plug connector housing 1 to assume a generally rectangular box-like configuration. Although not shown, the plug connector housing 1 accommodates therein the plug terminals to which harness wires, generally identified by Ha, are soldered or otherwise connected in any known manner so as to extend outwardly from the plug connector housing 1 through perforations defined in the end wall 1*e*.

It is to be noted that, since respective free ends of the plug terminals within the plug connector housing 1 terminate at a plane set inwardly from the opening of the plug connector housing 1, top, bottom and side wall portions of the plug connector housing 2 adjacent the opening thereof and opposite to the end wall 1*e* form a generally rectangular-sectioned hood which is generally identified by 3 and which is so oversized that the hood 3 can encircle a mating end portion of the socket connector as will be described later. It is also to be noted that, since the hood 3 is an integral part of the plug connector housing 1, the hood 3 is to be understood as comprised of parts of the top, bottom, side walls 1*a* to 1*e* of the plug connector housing for the purpose of the description of the preferred embodiments of the present invention.

For the purpose as will become clear from the subsequent description, the plug connector housing 1 has a pair of engagement pins 4 rigidly mounted on, or otherwise integrally formed with, respective parts of the side walls 1*c* and 1*d* forming the hood 3 so as to protrude laterally outwardly therefrom in coaxial relationship with each other.

The socket connector housing 2 includes a top wall 2*a*, a bottom wall 2*b*, a pair of inner side walls 2*c* and 2*d* and an end wall 2*e*, all assembled together to render the socket connector housing 2 to assume a generally rectangular box-like configuration substantially similar to that of the plug connector housing, but undersized relative thereto so that a front end portion thereof opposite to the bottom wall 2*e* can be received within the hood 3 in the plug connector housing 1. The socket connector housing 2 accommodates therein the socket terminals to which harness wires, generally identified by Hb, are soldered or otherwise connected in any known manner so as to extend outwardly from the socket connector housing 2 through perforations defined in the end wall 2*e*.

The socket connector housing 2 also includes a pair of outer side walls 5*a* and 5*b* of generally rectangular shape similar to the shape of the associated side wall 2*c* or 2*d* of the socket connector housing 2. Each of the outer side walls 5*a* and 5*b* is secured to, or otherwise integrally formed with, one end of the associated side wall 2*c* or 2*d* of the socket connector housing 2, adjacent the bottom wall 2*e*, in a substantially cantilever fashion so as to be positioned spaced a distance from the associated side wall 2*c* or 2*d* while defining a respective bearing chamber 6 between it and the associated side wall 2*c* or 2*d*. The outer side walls 5*a* and 5*b* have respective bearing holes 12 defined therein so that the bearing holes 12 in the respective outer side walls can coaxially align with each other.

Figure 3:
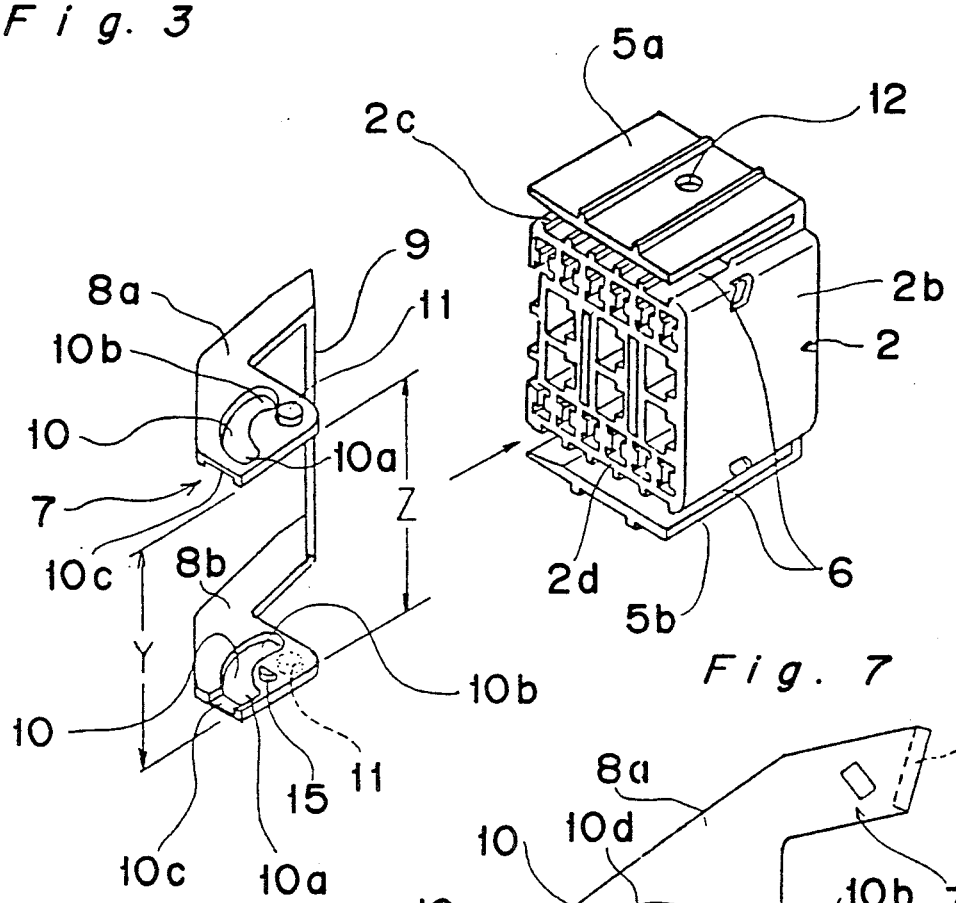
FIG. 3 is a perspective view of the socket connector with a lock handle shown as separated from a socket connector housing.
Figure 6:
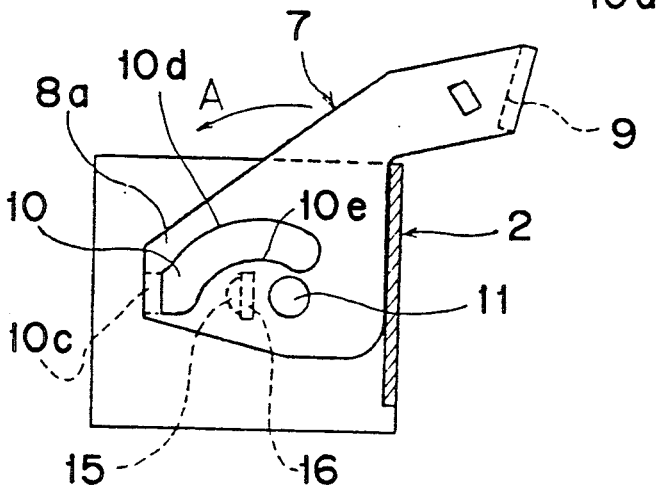
FIG. 6 is a schematic side view of the socket connector.
Figure 10:
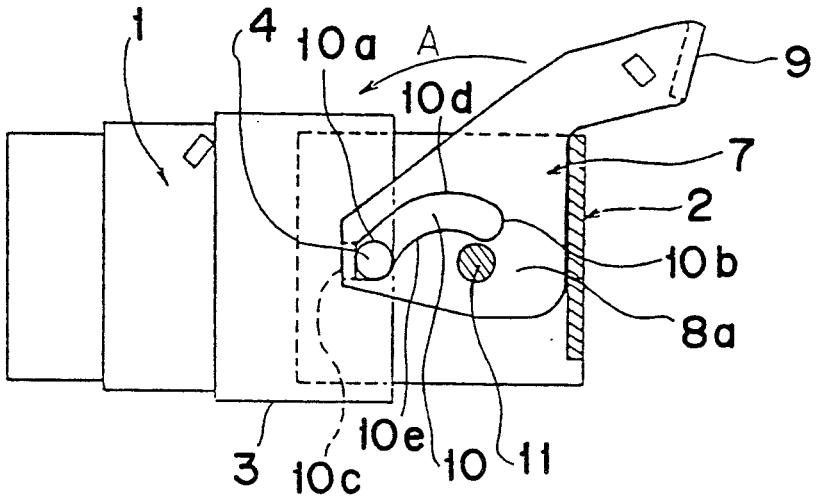
FIGS. 10 to 12 are schematic side views of the harness connector assembly showing the sequence in which the plug and socket connectors are connected together as the lock handle is angularly moved.
Figure 12:
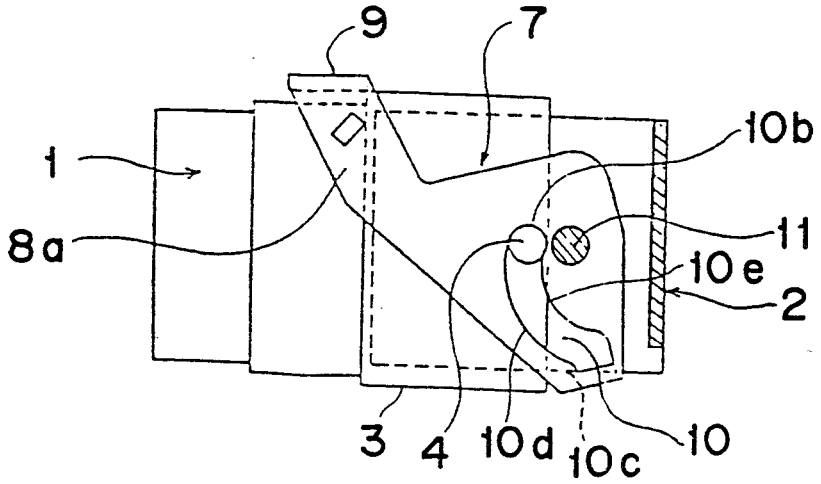

A lock handle is generally identified by 7 and includes, as best shown in FIG. 3, a pair of arms 8*a* and 8*b* of identical shape and a handle bar 9 having opposite ends connected or integrally formed with the arms 8*a* and 8*b* so as to render the lock handle 7 to represent a generally U-shaped configuration. A free end portion of each of the arms 8*a* and 8*b* opposite to the handle bar 9 is generally outwardly bulged and includes a bearing pin 11 formed therewith so as to extend laterally outwardly therefrom so that the bearing pins 11 on the respective arms 8*a* and 8*b* can coaxially align with each other. A generally guide slot 10 of a specific configuration as will be discussed later is defined in the bulged free end portion of each of the arms 8*a* and 8*b*. This lock handle 7 is pivotally mounted on the socket connector housing 2 with the bearing pins 11 engaged relatively rotatably in the bearing holes 12 that are defined in the outer side walls 5*a* and 5*b* such that the lock handle 7 can be pivotable about the bearing pins 11 between a release position, as shown in FIGS. 6 and 10, and a locked position as shown in FIG. 12. The mounting of the lock handle 7 on the socket connector housing 2 can be accomplished by inserting the bulged free end portions of the respective arms 8*a* and 8*b* into the bearing chambers 6, expanding the outer side walls 5*a* and 5*b* in a direction away from the adjacent inner side walls 2*c* and 2*d* of the socket connector housing 2 against their own resiliency so as to permit the associated bearing pins 11 on the bulged free end portions of the arms 8*a* and 8*b* to pass onto the respective bearing holes 12 and finally allowing the outer side walls 5*a* and 5*b* to snap into their original positions with the bearing holes 12 receiving therein the respective bearing pins 11 as best shown in FIGS. 4 and 5.

In describing the details of the guide slots 10 defined in the bulged free end portions of the respective arms 8*a* and 8*b*, reference will be made to only one of the guide slots 10, which is defined in the bulged free end portion of the arm 8*a*, because the arms 8*a* and 8*b* having the respective guide slots 10 are of identical configuration and are symmetrically positioned on respective sides of the handle bar 9.

Figure 7:
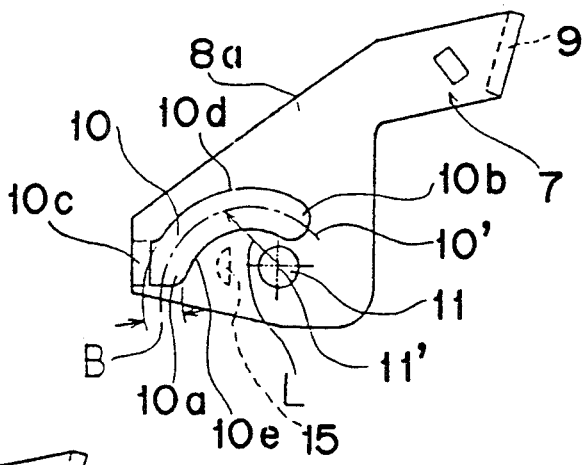
FIG. 7 is a schematic side view of the lock handle.

As best shown in FIG. 7, the respective guide groove 10 has leading and trailing ends 10*a* and 10*b*, opposite to each other with respect to the direction of pivotal movement of the lock handle 7 from the release position towards the locked position and extends angularly in an offset relationship with the adjacent bearing pin 11, and is delimited between long and short cam edges 10*d* and 10*e* confronting with each other. The guide slot 10 also has a longitudinal axis 10′ extending intermediate of the width B thereof which is substantially uniform over the entire length thereof. The guide slot 10 is so defined and so positioned in the bulged free end portion of the arm 8*a* that the distance, indicated by L in FIG. 7, between the longitudinal axis 11′ of the bearing pin 11 and the longitudinal axis 10′ of the guide slot 10 is minimum at the trailing end thereof and maximum at the leading end thereof. For the purpose which will become clear from the subsequent description, an area of the bulged free end portion of the arm 8*a* adjacent the leading end 10*a* of the guide slot 10 is formed with a straight guide groove 10*c* continued from the guide slot 10 for guiding the associated engagement pin 4 on the plug connector housing 1 therethrough into the guide slot 10.

Figure 4:
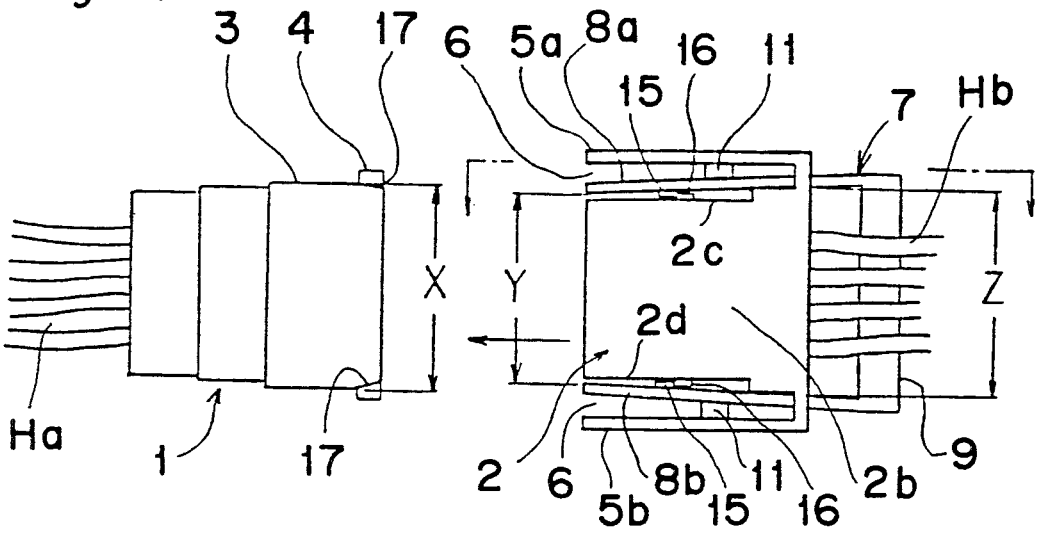
FIGS. 4 and 5 is schematic bottom plan view of the harness connector assembly held in conditions before and after connection between the plug and socket connectors, respectively.
Figure 5:
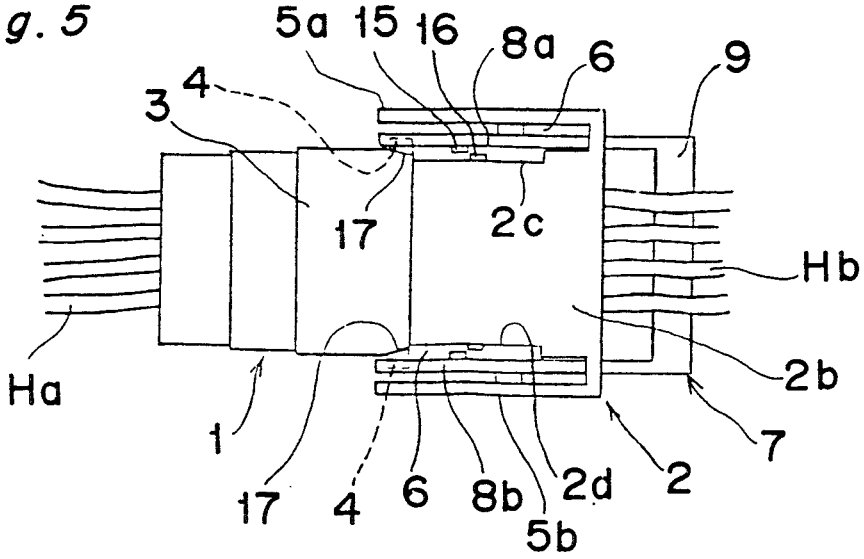

To connect the plug and socket connectors together to complete the connector assembly, the plug and socket connector housings 1 and 2 are aligned with each other substantially as shown in FIG. 4 and one of them, for example, the plug connector housing 1, is moved relative to and close towards the socket connector housing 2 until that end portion of the socket connector housing 2 opposite to the bottom wall 2*e* is loosely received within the hood 3 in the plug connector housing 1 substantially as shown in FIG. 5. When the plug and socket connector housings 1 and 2 are so aligned with each other, the straight guide grooves 10*c* in the respective arms 8*a* and 8*b* of the lock handle 7 then held at the release position are aligned with and confront the associated engagement pins 4 on the side walls 1*c* and 1*d* of the plug connector housing 1 and, when that end portion of the socket connector housing 2 is loosely received within the hood 3 of the plug connector housing 1, the engagement pins 4 on the side walls 1*c* and 1*d* of the plug connector housing 2 are received within the leading ends 10*a* of the respective guide slots 10, having passed through the associated straight guide grooves 10*c*, as shown in FIG. 10.

Figure 11:
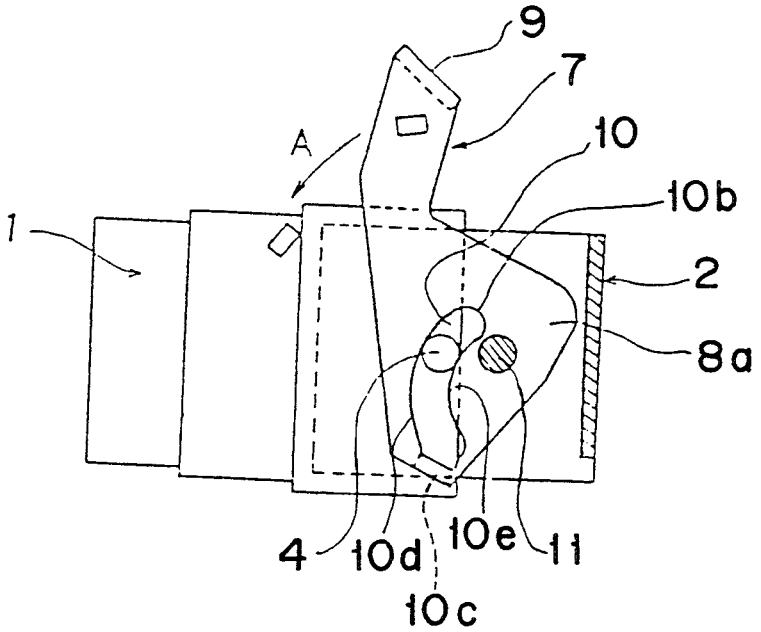

After the condition of FIG. 10 has been established and when the lock handle 7 is subsequently moved from the release position towards the locked position in a direction, shown by the arrow A in FIG. 10, by the application of an external pushing force to the handle bar 9, the long cam edges 10*d* of the respective guide slots 10 in the arms 8*a* and 8*b* slide over the associated engagement pins 4 while drawing the plug connector housing 1 close towards the socket connector housing 2 with that end portion of the socket connector housing 2 received deep into the hood 3 substantially as shown in FIG. 11. As that end portion of the socket connector housing 2 is received deep into the hood 3 in the manner described above, the plug terminals in the plug connector housing 1 are progressively plugged into the associated socket terminals in the socket connector housing 2 to substantially establish electric circuits between them.

When the lock handle 7 is completely moved to the locked position as shown in FIG. 12, that end portion of the socket connector housing 2 is completely received within the hood 3 while establishing the firm electric connection between the plug and socket terminals. In this condition, the engagement pins 4 are engaged in the trailing ends 10*b* of the respective guide slots 10 and the handle bar 9 rests on top of the plug connector housing 1.

Thus, it will readily be seen that each of the guide slots 10 is so shaped and so configured that, during the pivotal movement of the lock handle 7 from the release position towards the locked position, the plug connector housing 1 can be forcibly drawn close towards the socket connector housing 2 in cooperation with the associated engagement pin 4.

A reverse angular movement of the lock handle 7 from the locked position towards the release position allows the plug and socket connector housings 1 and 2 to be separated from each other. At this time, the short cam edges 10*e* of the guide slots 10 progressively push the engagement pins 4 so as to cause the plug connector housing 1 to separate from the socket connector housing 2 during the pivotal movement of the lock handle 7 from the locked position towards the release position and, therefore, after the lock handle 7 has been moved to the released position, the plug and socket connector housings 1 and 2 can easily be separated completely from each other manually.

The plug-in connector assembly, including the lock mechanism, of the construction so far shown and described may be of a construction disclosed and claimed in a Japanese Laid-open Utility Model Publication No. 3-4672, published Jan. 17, 1991, the invention of which was invented by Nori Inoue and has been assigned to the same assignee of the present invention.

Each of the engagement pins 4 which may be either integral or rigid with the respective side walls 1*c* and 1*d* of the plug connector housing 1 may be of a generally cylindrical shape. However, the use of the cylindrical engagement pins 4 may possibly bring about a problem which will now be discussed with reference to FIG. 30 showing only one of the engagement pins 4, which is secured to or formed integrally with the side wall 1*d* of the plug connector housing 1, and its associated guide groove 10.

Figure 30:
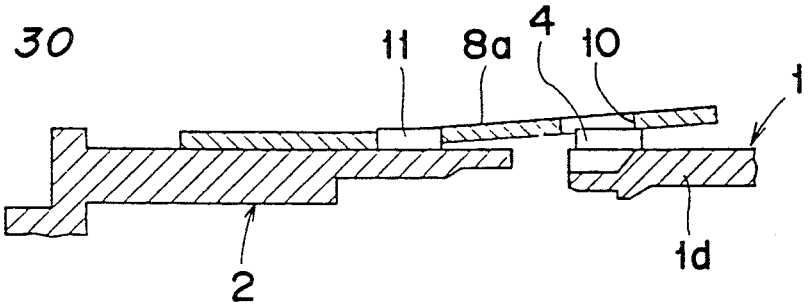
FIG. 30 is a view similar to FIG. 29, showing the manner in which the arm of the lock handle is disengaged from the corresponding bearing pin.

As shown in FIG. 30, if the lock handle 7 is violently and/or abruptly rotated or handled, it may possibly occur that the bulged end portion of one or both of the arms 8*a* and 8*b* floats relative to the associated side wall 1*d* with the engagement pin 4 disengaged from the associated guide slot 10 and the lock handle 7 may eventually fail to draw the plug connector 1 close to the socket connector housing 2.

Figure 29:
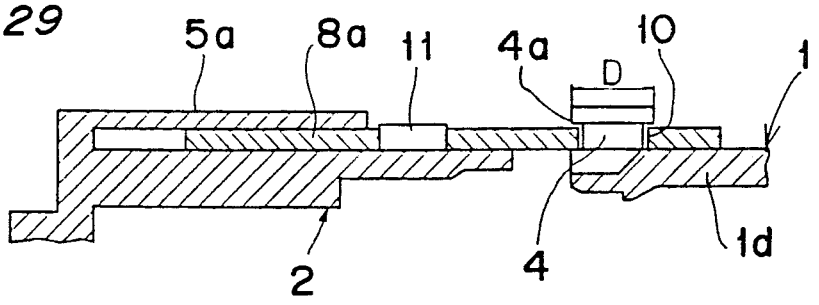
FIG. 29 is a schematic longitudinal sectional view showing the manner in which one of arms forming the lock handle is pivotally supported.

This possibility can be advantageously eliminated if each of the engagement pins 4 is employed in the form of a pin having a free end formed with a head 4*b* of a diameter D greater than the diameter of a shank portion of the engagement pin 4 as best shown in FIG. 29.

In order to minimize a friction which occurs between the long cam edges 10*d* of the guide slots 10 in the lock handle 7 and the associated engagement pins 4 in the plug connector housing 1 during the pivotal movement of the lock handle 7 from the release position towards the locked position and, also, between the short cam edges 10*e* of the guide slots 10 and the associated engagement pins 4 during the pivotal movement of the lock handle 7 from the locked position towards the release position, each of the engagement pins 4 employed in the plug connector housing 1 is rotatably supported by the associated side wall 1*c* or 1*d* in accordance with the present invention. To secure the respective engagement pin 4 to the associated side wall 1*c* or 1*d* of the plug connector housing 1 in a rotatable fashion, any suitable mounting method may be employed in the practice of the present invention, however, the employment of a mounting method shown in any one of FIGS. 9 and 13 to 15 is preferred, reference to which will now be made thereto for the discussion of the mounting method for rotatably securing any one of the engagement pins 4 to the associated side wall 1*c* or 1*d*.

Figure 9:
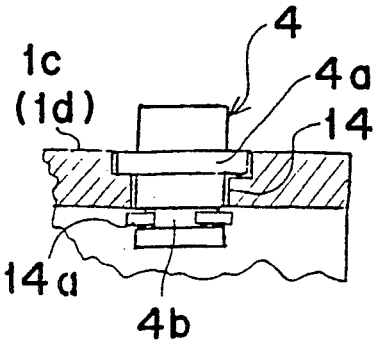
FIG. 9 is a schematic longitudinal sectional view, on an enlarged scale, of one of bearing pins used in the harness connector assembly for support of the lock handle.

Referring now to FIG. 9, the engagement pin 4 is of a generally cylindrical shape having an annular collar 4*a* formed integrally therewith so as to protrude radially outwardly from a substantially intermediate portion thereof and also having an annular groove 4*b* defined therein at a location adjacent one end thereof. On the other hand, the side wall 1*c* or 1*d* of the plug connector housing 1 has a corresponding bearing hole 14 of generally cylindrical configuration including a larger diameter portion and a reduced diameter portion. In order to mount the engagement pin 4 rotatably in the corresponding bearing hole 14, the engagement pin 4 is inserted into the bearing hole 14 so that the annular groove 4*b* in the engagement pin 4 can protrude a slight distance into a space within the hood 3 while the annular collar 4*a* is received within the larger diameter portion of the bearing hole 14, and thereafter, a split washer 14*a* is snapped into the annular groove 4*b* to avoid any possible separation of the engagement pin 4 from the bearing hole 14.

Figure 13:
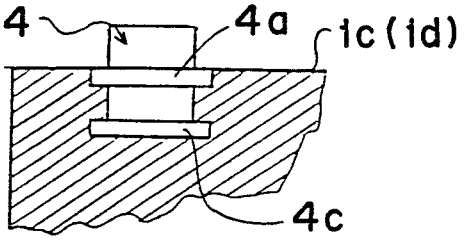
FIGS. 13 to 15 are schematic longitudinal sectional views, on an enlarged scale, showing respective modified forms of the bearing pin shown in FIG. 9.

In the example shown in FIG. 13, the engagement pin 4 of generally cylindrical shape is in the form having, in addition to the annular collar 4*a* shown in FIG. 9, an anchoring flange 4*c* formed integrally with one end thereof so as to protrude radially outwardly therefrom. This engagement pin 4 is mounted on, specifically in-molded in, the side wall 1*c* or 1*d* by the use of any known insert-molding technique. To ensure a rotatable feature of the engagement pin 4 after the latter has been in-molded in the side wall 1*c* or 1*d*, the engagement pin 4 may be made of a material, for example, metal, which is dissimilar to the material for the plug connector housing 1. Alternatively, where the engagement pin 4 is made of plastics, at least one end portion of the engagement pin 4 including the collar 4*a* and the anchoring flange 4*c* may be applied with an oily substance such as grease or wax before, in a mold designed to form the plug connector housing 1, a melt phase of plastics is injected into the mold.

Figure 14:
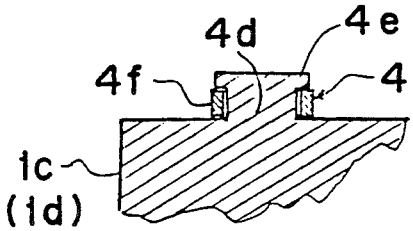

In the example shown in FIG. 14, the engagement pin 4 comprises a post 4*d* formed integrally with the side wall 1*c* or 1*d* by the use of any known plastics molding technique so as to have an anchoring head 4*d* radially outwardly protruding from a free end thereof, and a flat ring member 4*f* rotatably mounted on the post 4*d* and retained in position between the side wall 1*c* or 1*d* and the anchoring head 4*d*. In this example, only the flat ring member 4*f* contacts any one of the long and short cam edges 10*d* and 10*e*.

Figure 15:
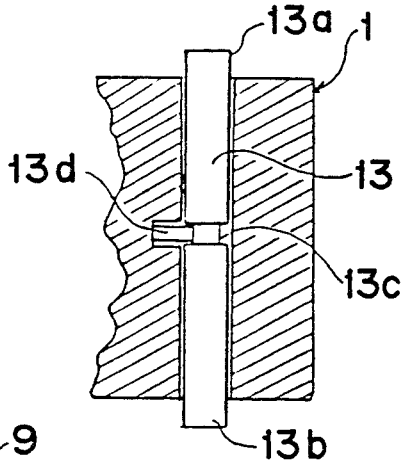

While in the foregoing embodiment the two engagement pins 4 are employed one for each side wall 1*c* and 1*d* of the plug connector housing 1. However, those engagement pins 4 may be constituted by respective opposite ends 13*a* and 13*b* of a single shaft member 13 as shown in FIG. 15. This shaft member 13 has a generally intermediate portion thereof formed with a radially inwardly extending engagement groove 13*a* and is rotatably inserted in a bearing hole defined in the plug connector housing 1. The shaft member 13 so inserted in the bearing hole in the plug connector housing 1 is retained in position by means of a generally elongated elastic stop 27 provided in the plug connector housing 1 and engaged loosely in the engagement groove 13*a* as shown in FIG. 15. With the elastic stop 13*d* engaged in the engagement groove 13*d* in the shaft member 13, the latter will not displace axially within the bearing hole in the plug connector housing 1 and will not separate away from the plug connector housing 1.

Also, for the purpose which will become readily understood from the subsequent description, as best shown in FIG. 4, respective parts of at least the side walls 1*c* and 1*d* of the plug connector housing 1 defining the hood 3 are exteriorly narrowed at 17 so as to have a reduced width smaller than the width X as measured from an outer surface of one side wall 1*c* to an outer surface of the other side wall 1*d*. On the other hand, the arms 8*a* and 8*b* of the lock handle 7 are of a shape twisted or molded to have a reduced span Y as measured between an inner surface of a front part of the bulged end portion of one arm 8*a* which confronts the plug connector housing 1 and an inner surface of a front part of the bulged end portion of the other arm 8*b*, which also confronts the plug connector housing 1, such that, when viewed from bottom as shown in FIG. 4, the span between the bulged end portions of the respective arms 8*a* and 8*b* of the lock handle can progressively reduce from a maximum span Z towards the reduced span Y.

In accordance with the present invention, the reduced span Y between the front parts of the bulged end portions of the respective arms 8*a* and 8*b* is chosen to be smaller than the width X of the plug connector housing 1 which is in turn chosen to be equal to or smaller than the maximum span Z between respective rear parts of the bulged end portions of the arms 8*a* and 8*b* which are opposite to those front parts thereof.

Accordingly, when that end portion of the socket connector housing 2 is inserted into the hood 3 of the plug socket connector housing 1 with that parts of the respective side walls 1*c* and 1*d* entering the associated bearing chambers 6 that are defined respectively between the inner and outer side walls 2*c* and 5*a*, 2*d* and 5*b*, the bulged end portions of the respective arms 8*a* and 8*b* are expanded respectively by that parts of the side walls 1*c* and 1*d* in a direction away from each other as shown in FIG. 5 against their own elasticity.

Figure 8:
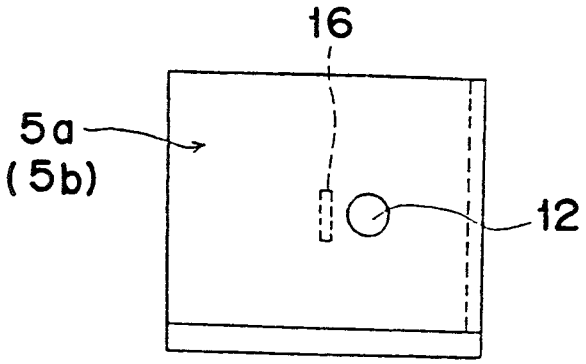
FIG. 8 is a schematic plan view of one of outer side walls in the socket connector.

In order to retain the lock handle 7 at the release position prior to that end portion of the socket connector housing 2 being inserted into the hood 3 of the plug connector housing 1, thereby to ensure that the engagement pins 4 can readily be guided into the associated straight guide grooves 10*c* in the lock handle 7 when the plug and socket connector housings 1 and 2 are aligned with each other, each of the arms 8*a* and 8*b* of the lock handle 7 is formed with a respective engagement projection 15 situated generally intermediate between the associated straight guide groove 10*c* and the associated bearing pin 11 as shown in FIGS. 3, 6 and 7. This engagement projection 15 is cooperable with a stopper projection 16 formed on each of the inner side walls 2*c* and 2*d* of the socket connector housing 2 as shown in FIG. 8.

The engagement projections 15 and the stopper projections 16 are so positioned and so configured that, when and so long as the lock handle 7 is held at the release position, the lock handle 7 can assume such a position as best shown in FIG. 10 with the straight guide grooves 10*c* aligned with the associated engagement pins 4 on the plug connector housing 1 with respect to the direction of insertion of one of the plug and socket connector housings 1 and 2 relative to and towards the other of the plug and socket connector housings 1 and 2 and that, when and after that end portion of the socket connector housing 2 is inserted into the hood 3 of the plug socket connector housing 1, as shown in FIGS. 5 and 10, with that parts of the respective side walls 1*c* and 1*d* entering the associated bearing chambers 6 that are defined respectively between the inner and outer side walls 2*c* and 5*a*, 2*d* and 5*b*, the bulged end portions of the respective arms 8*a* and 8*b* are expanded by that parts of the side walls 1*c* and 1*d* in a direction away from each other as shown in FIG. 5 against their own elasticity with the engagement projections 15 consequently disengaged from the stopper projections 16 as shown in FIG. 5, thereby bringing the lock handle 7 in a condition ready and easy to be pivoted from the release position towards the locked position.

Thus, it will readily be seen that, during the pivotal movement of the lock handle 7 between the release and locked positions about the longitudinal axis coaxial with the respective longitudinal axis 11' of the bearing pins 11, no substantial friction take place between the cam edges 10*d* and 10*e* defining the guide slots 10 and, therefore, the lock handle 7 can move smoothly.

It is also readily understood that, because of the employment of a temporary retaining means generally comprised of the detent projections 15 and the associated stopper projections 16, any possible arbitrary motion of the lock handle 7 while the plug and socket connector housings 1 and 2 are separated from each other can be advantageously avoided, thereby to facilitate a ready insertion of the socket connector housing 2 into the hood 3 of the plug connector housing 1 when connection is desired to be accomplished between the plug and socket connectors.

Furthermore, the arms 8*a* and 8*b* of the lock handle 7 are operatively housed within the associated bearing chambers 6 each defined between the inner and outer side walls 2*c* and 5*a*, 2*d* and 5*b*. The outer side walls 5*a* and 5*b* of the socket connector housing 2 essentially serve as protective coverings and, accordingly, no external force tending to move the lock handle 7 and/or to separate at least one bearing pin 11 away from the associated bearing hole 12 act on one or both of the arms 8*a* and 8*b* of the lock handle 7.

It is, however, to be noted that the temporary retaining means of the construction described above need not be always necessary in the practice of the present invention and may be dispensed with if desired. Also, the stopper projections 16 shown and described as formed on the respective side walls 2*c* and 2*d* may be respective parts of design indentations formed thereon, or the use of a single combination of one engagement projection 15 and a corresponding stopper projection 16 may suffice in the practice of the present invention.

It is also to be noted that, in the practice of the present invention, although the housings identified respectively by 1 and 2 have been referred to as the plug and socket connector housings, respectively, the housings 1 and 2 may be used as the socket and plug connector housings, respectively, in which case the lock handle 7 and their associated parts may be provided on either the plug connector housing or the socket connector housing.

According to a second preferred embodiment of the present invention, the plug-in connector assembly is provided with a detecting system for detecting whether or not the lock handle has been moved completely to the locked position thereby to provide an indication that the plug terminals in the plug connector have been electrically connected with the socket terminals in the socket connector. This will now be described in detail with particular reference to FIGS. 16 to 22.

Figure 16:
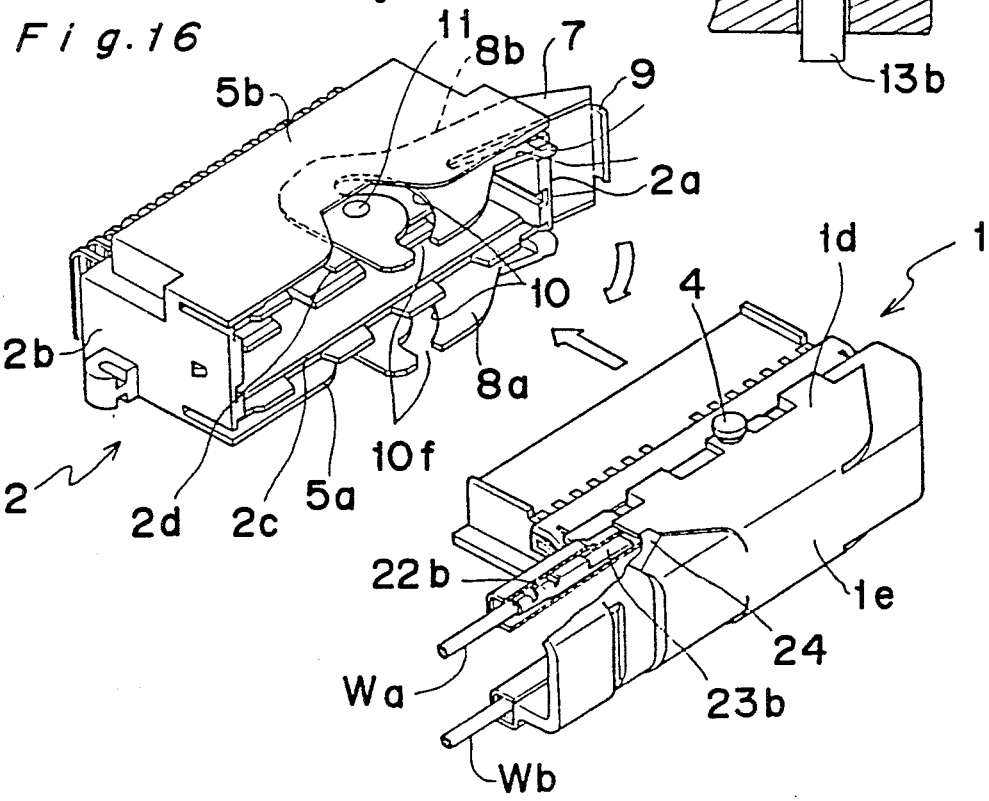
FIG. 16 is a perspective view of the harness connector assembly according to a second preferred embodiment of the present invention with the plug connector shown as separated from the socket connector.
Figure 17:
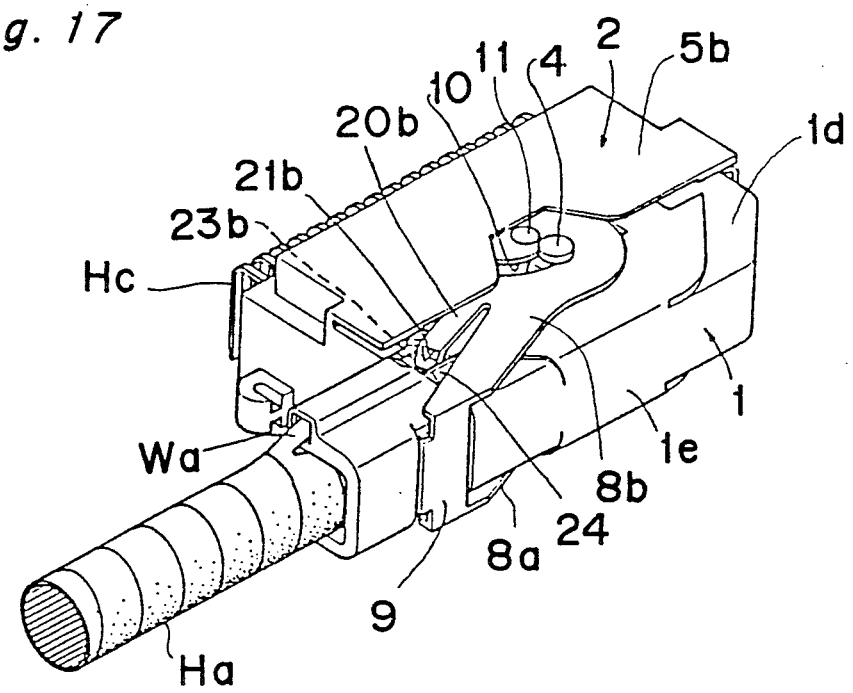
FIG. 17 is a perspective view of the harness connector assembly of FIG. 16 with the plug connector shown as connected with the socket connector.

Referring specifically to FIGS. 16 and 17, the plug connector housing 1 is shown to have the engagement pins 4 formed on the respective side walls 1*c* and 1*d* while the socket connector housing 2 is shown to have the lock handle 7 operatively carried thereby with the arms 8*a* and 8*b* rotatably mounted on the respective bearing pins 11.

It is to be noted that, although the specific shape of each of the plug and socket connector housings 1 and 2 shown therein is different from that shown particularly in FIG. 1, the plug and socket connector housings 1 and 2 used in the second preferred embodiment of the present invention are substantially similar to those shown in FIG. 1 except that the bearing pins 11 used in the second preferred embodiment of the present invention are secured rigidly to, or otherwise integrally formed with, the respective side walls 2*c* and 2*d* of the socket connector housing 2 and that, instead of the straight guide groove 10*c* defined in the bulged end portion of each of the arms 8*a* and 8*b* in the foregoing embodiment of the present invention, a straight guide slot 10*f* is employed in communication with the associated curved guide slot 10 as best shown in FIG. 9.

In addition, the socket connector housing 2 shown in FIGS. 16 and 17 is specifically designed for rigid mounting on an electrically operated device and, for this purpose, instead of the wire harness Hb shown in FIG. 1, it employs a plurality of terminal pins Hc protruding outwardly from the bottom wall of the socket connector housing 2 for electric connection with corresponding electric wires in the electrically operated device by means of soldering.

The plug and socket connectors are connected together in a manner substantially similar to that shown and described in connection with the foregoing embodiment of the present invention. Briefly speaking, with reference to FIGS. 21(*a*) to 21(*d*), assuming that the socket connector housing 2 is rigidly mounted on a casing for the electrically operated device with its opening oriented upwards as shown therein, the straight guide slots 10*f* leading into the curved guide slots 10*a* in the bulged end portions of the respective arms 8*a* and 8*b* are oriented upwards when and so long as the lock handle 7 is held in the release position as shown in FIG. 21(*a*). When the plug connector housing is inserted into the socket connector housing 2 after the alignment, the engagement pins 4 are immediately received within the straight guide slots 10*f* as shown in FIG. 21(*b*) in readiness for entry into the associated curved guide slots 10.

Subsequent push or pull of the handle bar 9 to cause the lock handle 7 to move from the release position towards the locked position about the longitudinal axes 11' of the respective bearing pins 11 rigid or fast with the side walls 2*c* and 2*d* of the socket connector housing 2 allows the long cam edges 10*d* (FIG. 19) to slide over the associated engagement pins 4 while drawing the plug connector housing 1 close towards the socket connector housing 2 to permit the former to be further inserted into the latter as shown in FIG. 21(*c*). At this time, the plug terminals have not yet been completely engaged in the respective socket terminals. However, when the lock handle 7 is completely moved to the locked position in which condition the handle bar 9 is held flat against the bottom wall 1*e* of the plug connector housing 1 as shown in FIG. 21(*d*), the plug connector housing 1 is completely received within the socket connector housing 2 with the plug terminals consequently engaged in the associated socket terminals completely.

Figure 19:
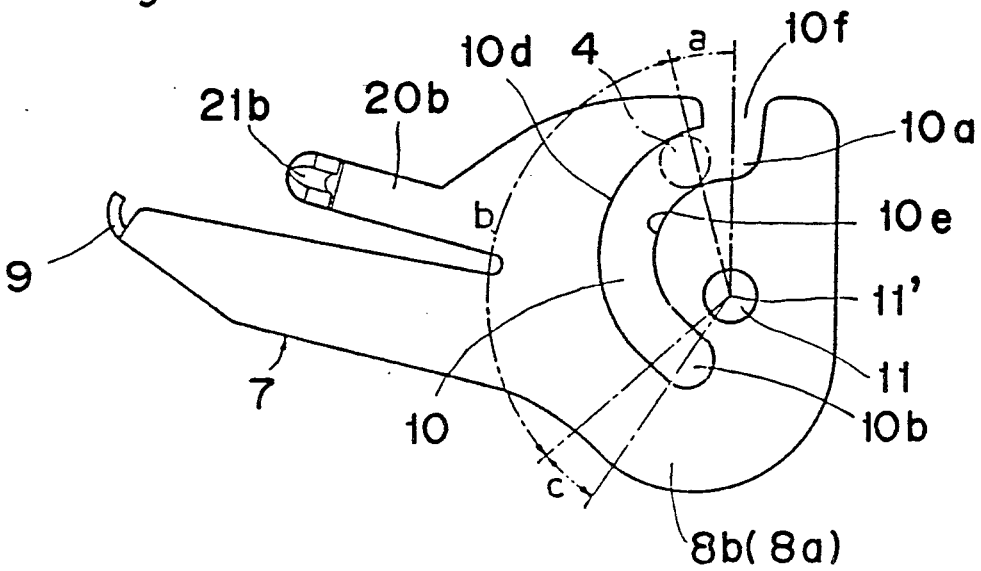
FIG. 19 is a view similar to FIG. 7, showing the lock handle used in the practice of the second preferred embodiment of the present invention.

As is the case with the bulged end portion of each of the arms 8*a* and 8*b* of the lock handle 7 shown in and described with particular reference to FIG. 7, the curved guide slot 10 defined in each bulged end portion is, as best shown in FIG. 19, so curved as to have its center of curvature located laterally offset from the axis 11' of rotation of the lock handle 7 such that the distance between the axis 11' of rotation of the lock handle 7 and the leading end 10*a* of the respective curved guide slot 10 is greater than that between the axis 11' of rotation and the trailing end 10*b* of the respective curved guide slot 10. However, the curved guide slot 10 shown in FIG. 19 differs from that shown in FIG. 7 in that the leading end 10*b* is oversized relative to an outer diameter of the corresponding engagement pin 4 to facilitate receipt of such corresponding engagement pin 4 in the leading end 10*a* of the guide slot 10 through the straight guide slot 10*f* and that the trailing end 10*b* thereof extends straight over a slight distance so as to provide a play to the lock handle 7 moved to the locked position.

Preferably, referring to FIG. 19, the curved guide slot 10 in the bulged end portion of each of the arms 8*a* and 8*b* is so shaped and so configured that the leading end 10*a* angularly extends an angle a, which may correspond to about 15 degrees of rotation of the lock handle 7 about the axis 11' of rotation thereof; the trailing end 10*b* extends straight over an angle c which may correspond to about 20 degrees of rotation of the lock handle 7 about the axis 11' of rotation thereof; and a portion of the curved guide slot 10 intermediate between the leading and trailing ends 10*a* and 10*b* angularly extends an angle b which may correspond to about 110 degrees of rotation of the lock handle 7 about the axis 11' of rotation thereof.

With each curved guide slot 10 having been so shaped and so designed as shown in and described with reference to FIG. 19, when and after the socket and plug connector housings 1 and 2 have been aligned with each other while the lock handle 7 is held in the release position with the straight guide slots 10*f* oriented upwards so as to confront the respective engagement pins 4 as shown in FIG. 21(*a*), the plug connector housing 1 is inserted into the socket connector housing 2 with the engagement pins 4 consequently loosely received in the respective straight guide slots 10*f* as shown in FIG. 21(*b*). Since each of the straight guide slot 10*f* continued to the leading end 10*a* of the associated curved guide slot 10 has a width greater than the outer diameter of the corresponding engagement pin 4, the engagement pins 4 can readily be received into the leading ends 10*a* through the associated straight guide slots 10*f*. Thereafter, the lock handle 7 is pivoted about the axis 11' in a direction shown by the arrow A from the release position towards the locked position. During the rotation of the lock handle 7 through the angle a of about 15 degrees from the release position, the engagement pins 4 make an idle movement relative to the lock handle 7 being rotated without the plug connector housing 1 being positively drawn close towards the socket connector housing 2, because the width of each of the leading ends 10*a* is greater than the outer diameter of the corresponding engagement pin 4 as hereinabove described.

However, during the further rotation of the lock handle 7 through the angle b of about 110 degrees, the engagement pins 4 relatively slide along the long cam edges 10*d* and, accordingly, as shown in FIG. 21(*c*), the plug connector housing 1 is positively drawn close towards the socket connector housing 1 so that the plug terminals can be further engaged in the socket terminals to establish electric circuits therebetween. After the plug terminals have been completely engaged in the corresponding socket terminals, the lock handle 7 pivots the angle c of about 20 degrees by the effect of an inertia force further towards the locked position with the engagement pins 4 relatively moving within the straight trailing ends 10*b* until the lock handle 7 assumes the locked position as shown in FIG. 21(*d*).

Figure 20:
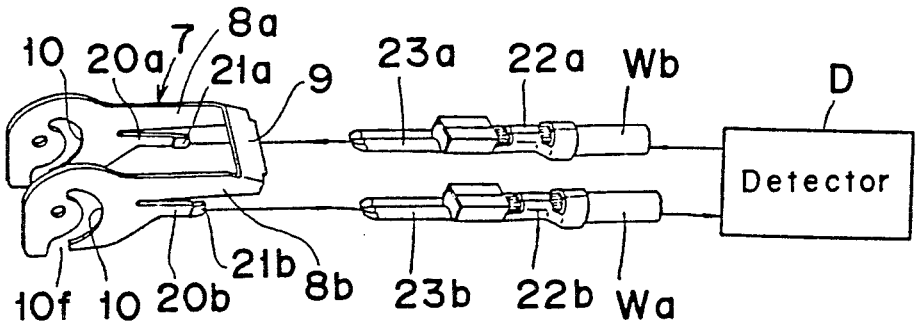
FIG. 20 is a schematic diagram showing the lock handle connected electrically with a connection detector according to a third preferred embodiment of the present invention.
Figure 21A:
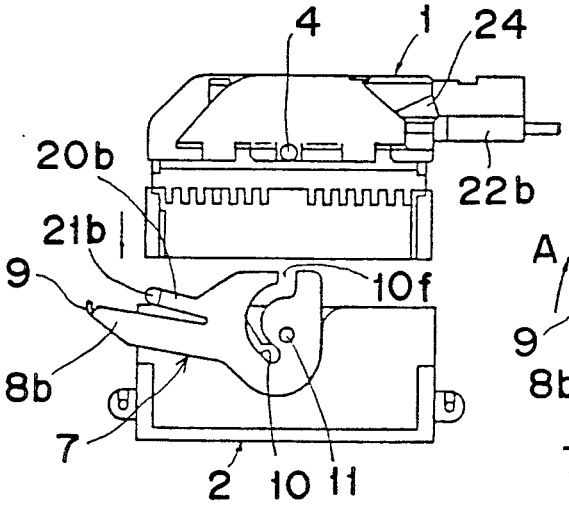
FIGS. 21 (*a*) to 21 (*d*) are schematic side views of the harness connector assembly of FIGS. 16 and 17 showing the sequence in which the plug and socket connectors are connected together as the lock handle is angularly moved.
Figure 21B:
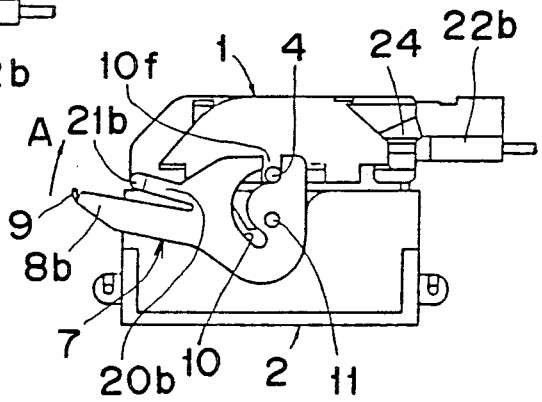
Figure 21C:
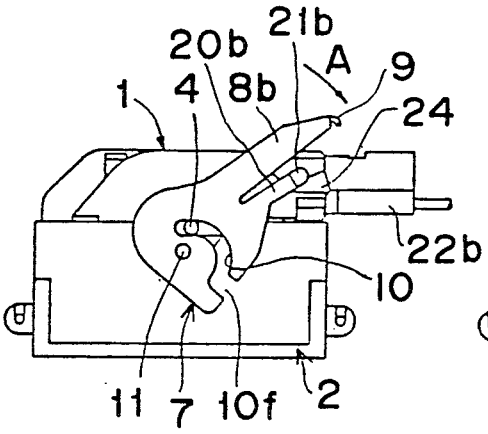
Figure 21D:
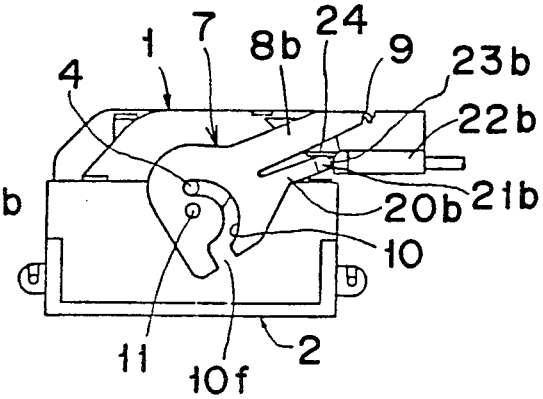

The detecting system for detecting whether or not the lock handle 7 has been moved completely to the locked position thereby to provide an indication that the plug terminals in the plug connector have been electrically connected with the socket terminals in the socket connector is best shown in FIG. 20. In order for the detecting system to be utilizable in the plug-in connector assembly according to the present invention, the lock handle 7 is made of electroconductive material and is formed integrally with elastic contact tongues 20*a* and 20*b* extending from the corresponding bulged end portions of the respective arms 8*a* and 8*b* in a direction towards the handle bar 9 in a generally parallel relationship with the adjacent arms 8*a* and 8*b*. Each of the contact tongues 20*a* and 20*b* has a free end opposite to the bulged end portion of the associated arm 8*a* or 8*b* which is, as best shown in FIGS. 18 and 19. substantially curled about the longitudinal axis thereof to define a generally convex contact element 21*a* or 21*b* such that a convex contact surface of one contact element 21*a* and that of the other contact element 21*b* confront with each other.

Cooperable with those contact elements 21*a* and 21*b* integral with the respective contact tongues 20*a* and 20*b* is generally elongated terminal members 22*a* and 22*b*. Each of these terminal members 22*a* and 22*b* has one end formed into a contact element 23*a* and 23*b* and the opposite end electrically connected with a connection detector D by means of a respective lead Wa or Wb.

These terminal members 22*a* and 22*b* are so secured to and so positioned in the respective side wall 2*c* and 2*d* (the side wall 2*d* being not shown in FIGS. 16 to 21, except for FIG. 18) of the plug connector housing 1 made of electrically insulating material that, when the lock handle 7 has been completely pivoted to the locked position, the contact elements 21*a* and 21*b* of the contact tongues 20*a* and 20*b* can be electrically connected with the contact elements 23*a* and 23*b* of the terminal members 22*a* and 22*b*, respectively, in a manner as will be described in detail.

Figure 18:
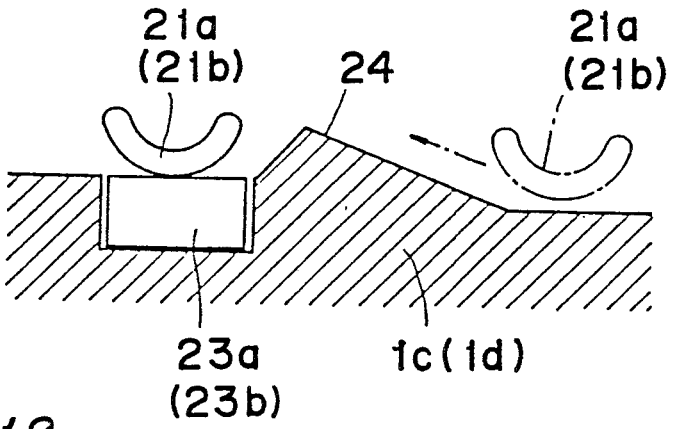
FIG. 18 is a schematic sectional diagram showing an electric connection between terminal members used to detect a complete connection between the plug and socket connectors.

The side walls 1*c* and 1*d* of the plug connector housing 1 have respective detent projections 24 formed therein at a position aligned with the path of angular movement of the corresponding contact element 21*a* or 21*b* of the contact tongue 20*a* or 2*b* so that, as the lock handle 7 being pivoted approaches the locked position, the contact elements 21*a* and 21*b* can slide over the corresponding detent projections 24, as shown by the phantom lines in FIG. 18, while causing the contact tongues 20*a* and 20*b* to deform against their own resiliency, and subsequently fall into contact with the associated contact elements 23*a* and 23*b* of the terminal members 22*a* and 22*b* having slid down the projections 24 as shown by the solid lines in FIG. 18.

The detent projections 24 serve to inhibit a reverse movement of the lock handle 7 from the locked position back towards the release position in engagement with the contact elements 21*a* and 21*b* of the contact tongues 20*a* and 20*b*, thereby to keep the lock handle 7 locked in the locked position once it has been angularly moved thereto. This is possible because, once the lock handle 7 has been moved completely to the locked position as described hereinbefore, the projections 24 occupy respective positions trapped within respective detent spaces defined between the arms 8*a* and 8*b* and the contact tongues 10*a* and 20*b*.

So far shown in FIG. 20, an electric circuit extending from the terminal member 22*a* to the other terminal member 22*b* via the lock handle 7 is a series circuit and, accordingly, the connection detector D may be of a type including a series-connected circuit of an electric power source, for example, a battery, and an indicator such as, for example, a light emitting diode and/or a potentiometer. In addition thereto or alternatively, the detector D may include a signal generator for generating, when the lock handle 7 has been moved completely to the locked position with the contact elements 21*a* and 21*b* engaged respectively with the contact elements 23*a* and 23*b*, an output which may be utilized in any suitable manner, for example, in a computer-assisted assembling machine in an automatic connector production line. As a matter of course, the connection detector D may be disconnected from the circuit including the terminal members 22*a* and 22*b*, once the complete connection between the plug and socket terminals have been confirmed in reference to the indication provided by the connection detector D.

Figure 22:
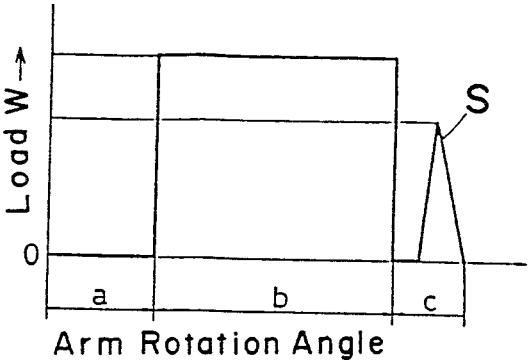
FIG. 22 is a graph showing a change in magnitude of a force necessary to pivot the lock handle from a release position towards a locked position.

A relationship between the angle of rotation of the lock handle 7 and the external force applied to the lock handle 7 to rotate the latter, that is, a load w applied to the arms 8*a* and 8*b*, in the second preferred embodiment of the present invention is shown in FIG. 22. As shown therein, because of the presence of the detent projections 24 over which the contact elements 21*a* and 21*b* slide as the lock handle 7 approaches the locked position, the external force applied to the lock handle 7 to rotate the latter is required to be increased as shown by a spike S.

FIGS. 23 to 25 and FIGS. 26 to 28 illustrate different application of the concept of the present invention to the plug-in connector assembly comprising the plug and socket connector housings of generally cubic configuration.

Figure 23:
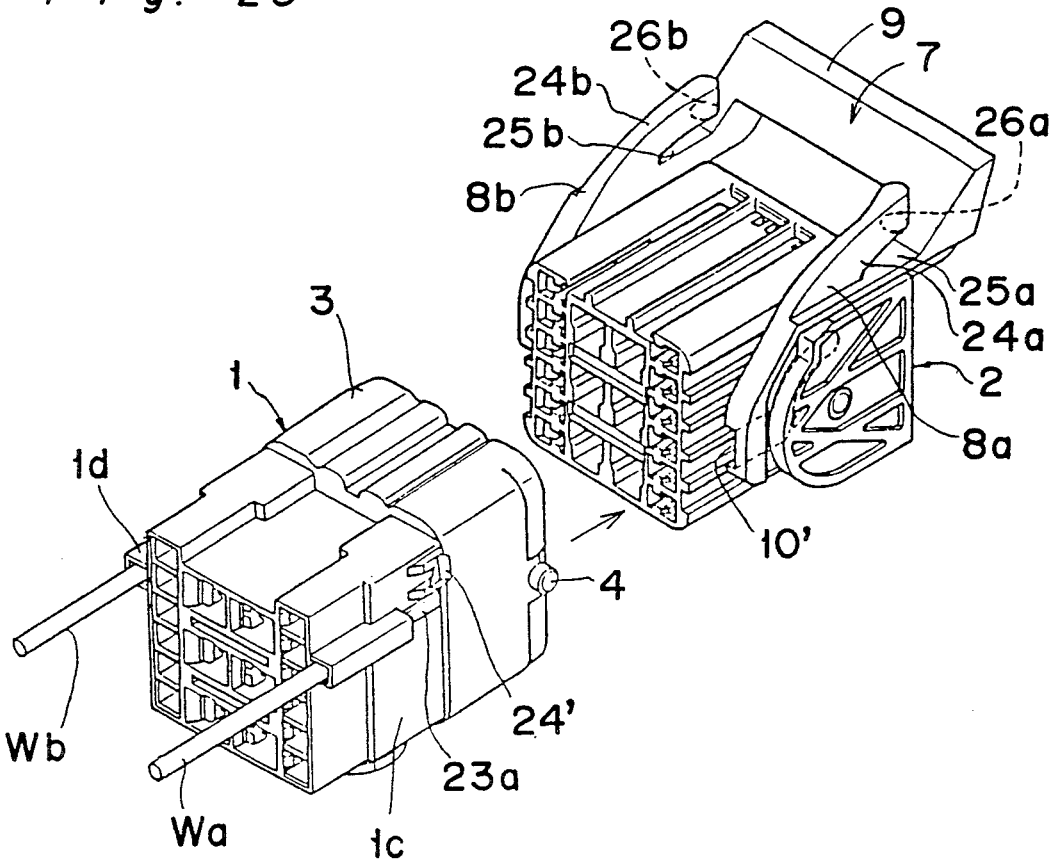
FIGS. 23 to 25 are perspective views showing the sequence in which the plug and socket connectors of the harness connector assembly according to a fourth preferred embodiment of the present invention are connected.
Figure 24:
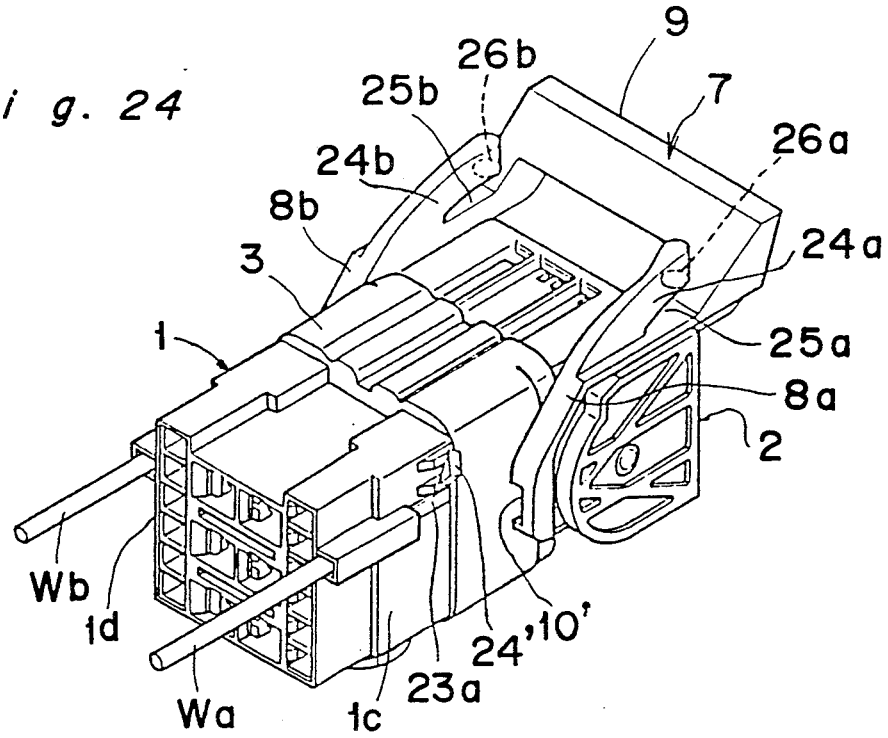
Figure 25:
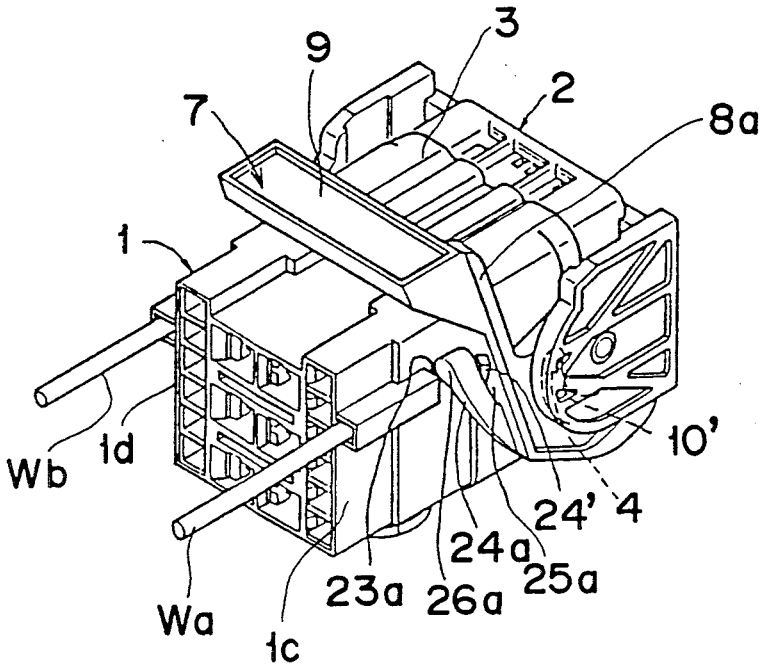

In the example shown in FIGS. 23 to 25, the terminal members having the respective contact elements 23*a* and 23*b* are carried by the opposite side walls 1*c* and 1*d* of the plug connector housing 1 at specific locations as will be described later. The lock handle 7 employed in the embodiment of FIGS. 23 to 25 is of a type having the arms 8*a* and 8*b* each being curved in an offset relationship to the axis of rotation of the lock handle 7 and formed integrally with a generally elongated elastic contact tongues 24*a* or 24*b* protruding from the bulged end portion of the corresponding arm 8*a* or 8*b* in a direction close towards the handle bar 9 while defining a detent space 25*a* or 25*b* between it and the adjacent arm 8*a* or 8*b*. The contact tongues 24*a* and 24*b* have their respective free ends serving as respective contact areas 26*a* and 26*b* adapted to be electrically connected with the contact elements 23*a* and 23*b* on the plug connector housing 1 as shown in FIG. 25.

Detent projections 24' engageable into the detent spaces 25*a* and 25*b*, respectively, for locking the lock handle 7 in the locked position once the latter has been moved thereto are formed on the respective side walls 1*c* and 1*d* of the plug connector housing 1 so as to protrude laterally outwardly. Thus, it will readily be seen that, when the lock handle 7 has been moved from the release position as shown in FIG. 23 to the locked position as shown in FIG. 25, not only are the contact areas 26*a* and 26*b* of the respective contact tongues 24*a* and 24*b* brought into contact with the contact terminals 23*a* and 23*b* to complete an electric circuit between the lead lines Wa and Wb via the lock handle 7, but also the lock handle 7 is held locked in the locked position with the detent projections 24' trapped within the detent spaces 25*a* and 25*b* as shown in FIG. 25.

Figure 26:
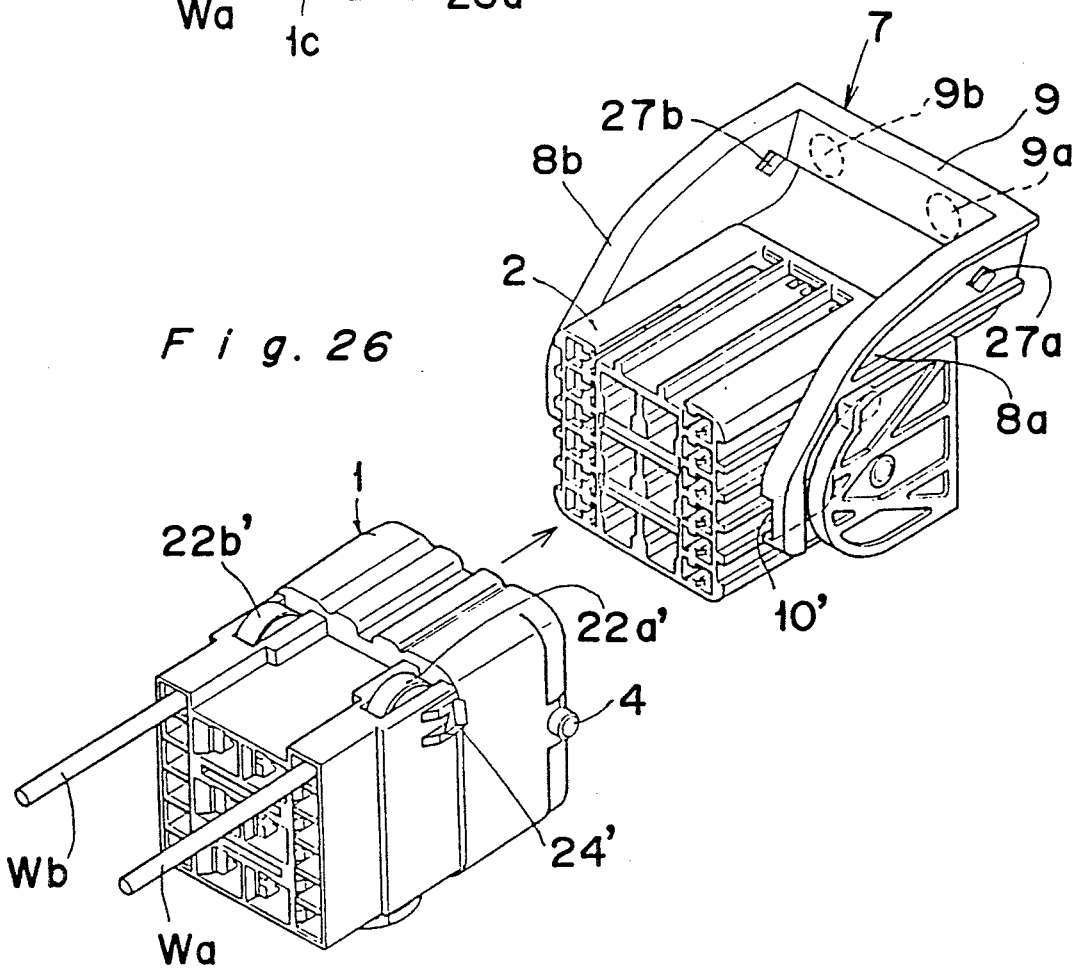
FIGS. 26 to 28 are perspective views showing the sequence in which the plug and socket connectors of the harness connector assembly according to a fifth preferred embodiment of the present invention are connected.
Figure 27:
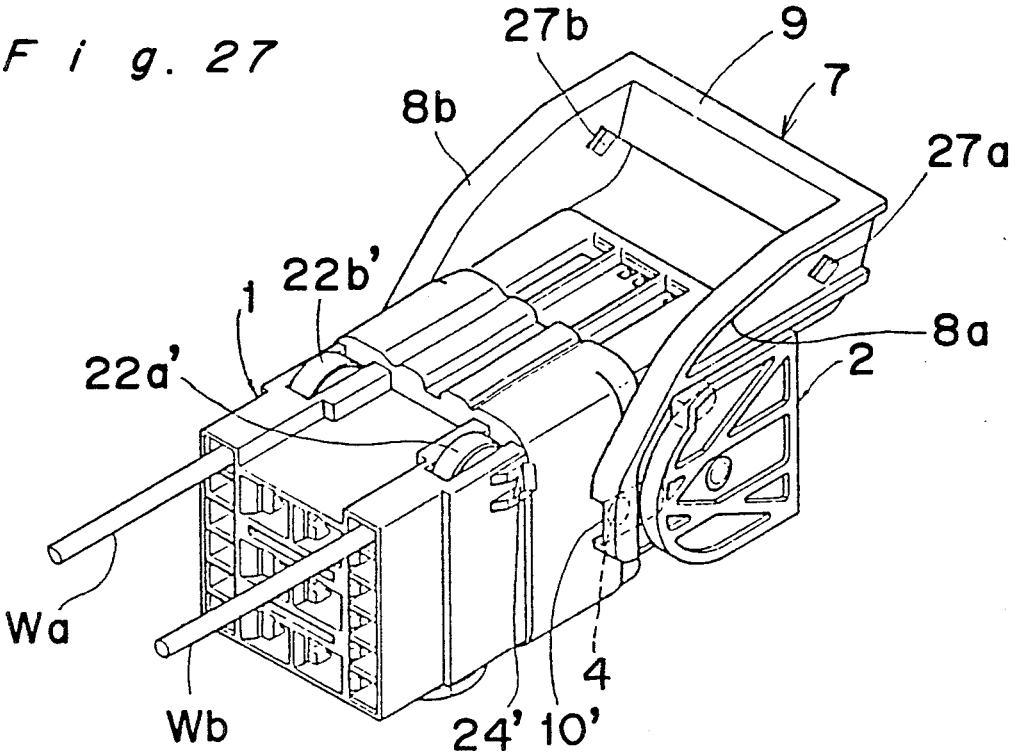
Figure 28:
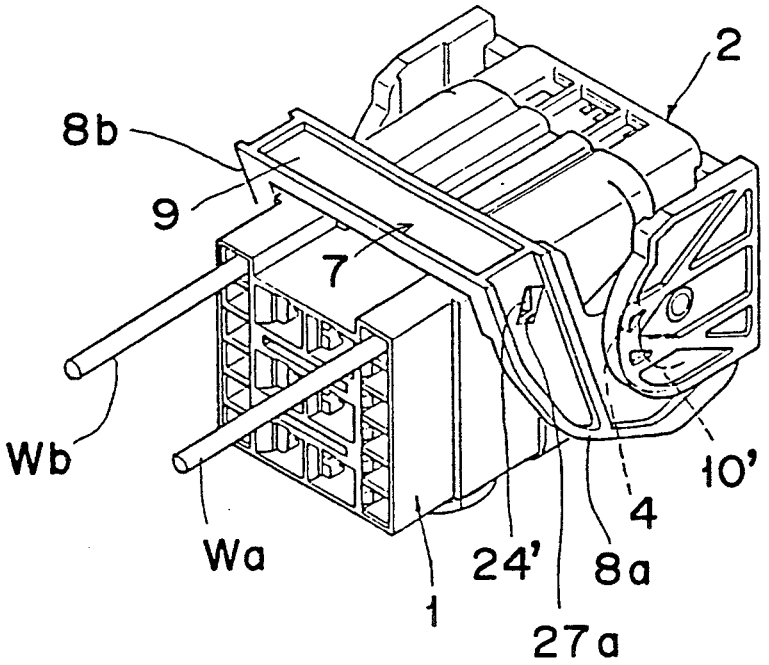

In the example shown in FIGS. 26 to 28, the lock handle 7 shown therein is substantially similar to that shown in FIGS. 23 to 25 except that no elastic contact tongue is employed and, hence, no detent space is defined. Instead, detent performations 27*a* and 27*b* cooperable with the detent projections 24' on the plug connector housing 1 are employed and are defined in respective end portions of the arms 8*a* and 8*b* adjacent the handle bar 9 of the lock handle 7 as best shown in FIGS. 26 and 27 and, also, the handle bar 9 has spaced apart contact areas 9*a* and 9*b* defined therein. Those contact areas 9*a* and 9*b* of the handle bar 9 are, when the lock handle 7 is moved to the locked position as shown in FIG. 28, brought into contact with spring contacts 22*a*' and 22*b*' mounted on the top wall 1*a* of the plug connector housing 1 and connected with the respective lead lines Wa and Wb as best shown in FIGS. 26 and 27.

In describing any one of the foregoing embodiments wherein the connection detecting system is employed, the lock handle 7 has been described as made of electroconductive material. The use of the electroconductive material for the lock handle 7 may not be always essential and the lock handle 7 may be made of synthetic resin. Where the lock handle 7 is made of synthetic resin, that is, an electrically insulating material, a generally elongated conductor such as, for example, a printed circuit element or a metal strip, may be embedded in the lock handle 7 to provide a circuit element necessary to shortcircuit between the contact elements 23*a* and 23*b* upon arrival of the lock handle 7 at the locked position, while opposite ends of the elongated conductor embedded in the lock handle 7 should be exposed bare for engagement with the associated contact elements 23*a* and 23*b*.

In any one of the foregoing embodiments of the present invention, the guide path along which any one of the engagement pins 4 moves relative to the associated arm 8*a* or 8*b* during the rotation of the lock handle 7 has been shown and described as employed in the form of the curved guide slot 10 which opens completely across the thickness of the bulged end portion of the associated arm 8*a* or 8*b*. However, instead of the use of the curved guide slot 10 for each arm 8*a* and 8*b*, a curved guide groove may be employed as shown in any one of FIGS. 31 and 32 each illustrating a single combination of one engagement pin 4 with the associated guide path.

Figure 31:
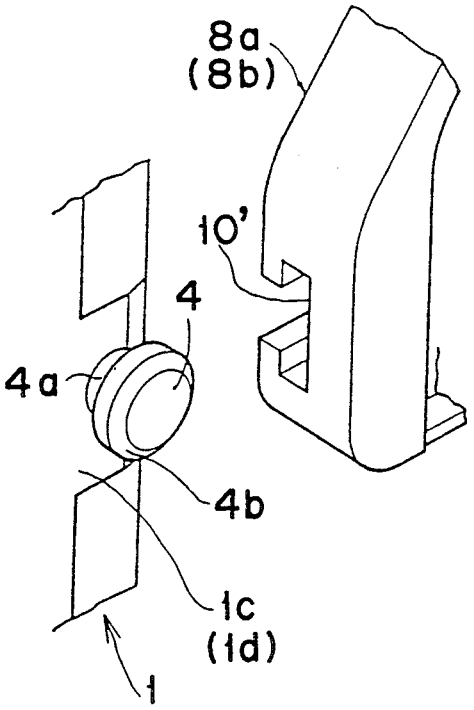
FIGS. 31 and 32 are schematic perspective views, on an enlarged scale, showing modified forms of the bearing pin, respectively.

Referring first to FIG. 31, each engagement pin 4 is of a type comprising a generally cylindrical shank 4*a* secured at one end to the associated side wall 1*c* or 1*d* and a disc-shaped head 4*b* secured to a free end of the shank 4*a*, thereby rendering the respective engagement pin 4 to represent a generally T-shaped configuration. In correspondence with the T-shaped configuration of the respective engagement pin 4, the curved guide path is comprised of a generally T-sectioned guide groove 10' which is of a shape substantially similar to the guide slot 10 discussed hereinbefore.

The combination of the generally T-shaped engagement pins 4 with the generally T-sectioned guide grooves 10' is shown as employed in any one of the embodiments of FIGS. 23 to 25 and FIGS. 26 to 28.

In the example shown in FIG. 31, each engagement pin 4 is of a shape having its shank tapering towards the associated side wall 1*c* or 1*d* while the guide path defined in the bulged end portion of each of the arms 8*a* and 8*b* is employed in the form of a curved guide groove 10" having a cross-sectional shape complemental to the shape of the tapering engagement pin 4.

Figure 32:
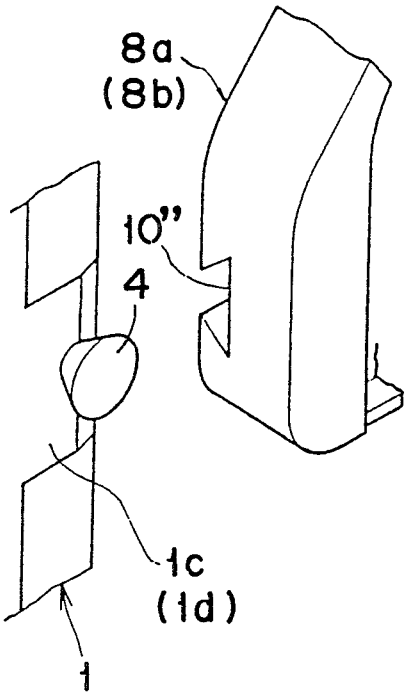

In any event, the use of the combination of the engagement pins with the guide grooves such as shown in any one of FIGS. 31 and 32 is particularly advantageous in that the problem discussed with particular reference to FIG. 30 can be substantially eliminated.

With the present invention having been described in connection with the preferred embodiments thereof, various changes and modifications are apparent to those skilled in the art upon the reading of the disclosure herein made. By way of example, each engagement pin 4 shown in FIG. 31 may have a tubular member rotatably mounted on the shank thereof for the purpose of minimizing the friction between it and the lock handle during the rotation of the latter.

Also, the socket connector housing which has been described as having the outer side walls may not be always provided with such outer side walls, although the use of the outer side walls is preferred to substantially avoid an undesirable contact of each of the arms of the lock handle with an external obstructions which would otherwise disengage one or both of the arms from the associated bearing pins.

In addition, although in describing the preferred embodiments of the present invention reference has been made to the plug-in connector assembly comprising the plug connector and the socket connector, which may be generally referred to as a pin-plug connector assembly or a plug-and-socket connector assembly, the present invention can be equally applicable to any other connector assembly, for example, of a point-to-point contact type wherein a plurality of pins or flat or round contact elements in one connector housing are adapted to be brought into contact with a corresponding number of flat or round contact elements in a mating connector housing.

Accordingly, such changes and modifications are to be understood as included within the scope of the present invention unless they depart therefrom.

What is claimed is:

1. A connector assembly which comprises, in combination:

a first connector housing having a plurality of first electric terminal elements;

a second connector housing having a corresponding number of second electric terminal elements adapted to be electrically connected with the first electric terminal elements when the first and second connector housings are connected together;

a pair of engagement pin members mounted on the first connector housing so as to protrude outwardly therefrom and positioned on respectively sides of said first connector housing;

a lock handle having a pair of spaced apart arms and a handle bar connected at opposite ends with said arms, said lock handle also having an axis of rotation thereof substantially perpendicular to each of the arms and being angularly displaceably mounted on the second connector housing with said arms positioned on respective sides thereof for rotation between a release position, in which said first and second connector housings are separated from each other, and a locked position in which said first and second connector housings are connected together with the first terminal elements electrically completely connected with the second terminal elements;

a shaped cam means defined in a free end portion of each of the arms and cooperable with the corresponding engagement pin member, said shaped cam means being of a generally arcuate shape having a center of curvature which is located offset from the axis of rotation of the lock handle whereby, as the lock handle is rotated from the release position towards the locked position after the first and second connector housings have been aligned with each other, the corresponding engagement pin member is guided along the shaped cam means allowing the first connector housing to be drawn relative to and close towards the second connector housing thereby to accomplish a complete electric connection between the first and second terminal elements upon arrival of the lock handle at the locked position;

each of said engagement pin members having a friction-reducing element to facilitate a relative movement of the respective engagement pin member along the shaped cam means during the rotation of the lock handle between the release and locked positions; and a detecting means for detecting a complete arrival of the lock handle to the locked position and for providing an indication that, consequent upon the complete arrival of the lock handle at the locked position, the first and second terminal members are electrically completely connected together wherein said detecting means comprises a pair of first contact elements carried by the first connector housing and adapted to be electrically connected with a detector for providing the indication, and a pair of second contact elements carried by the lock handle and electrically connected with each other.

2. The connector assembly as claimed in claim 1, wherein the lock handle is made of electroconductive material and wherein said second contact elements are constituted by different portions of the lock handle.

3. The connector assembly as claimed in claim 1, further comprising a temporary retaining means for retaining the lock handle at the release position thereby to avoid an arbitrary motion of the lock handle about the axis of rotation thereof.

4. The connector assembly as claimed in claim 3, wherein said temporary retaining means comprises a detent projection and a detent receptacle, one of said detent projection and receptacle being formed on one of the second connector housing and each of the arms of the lock handle and the other of said detent projection and receptacle being formed on the other of the second connector housing and each of the arms.

5. A connector assembly which comprises, in combination:

a first connector housing having a plurality of first electric terminal elements;

a second connector housing having a corresponding number of second electric terminal elements adapted to be electrically connected with the first electric terminal elements when the first and second connector housings are connected together;

a pair of engagement pin members mounted on the first connector housing so as to protrude outwardly therefrom and positioned on respective sides of said first connector housing;

a lock handle having a pair of spaced apart arms and a handle bar connected at opposite ends with said arms, said lock handle also having an axis of rotation thereof substantially perpendicular to each of the arms and being angularly displaceably mounted on the second connector housing with said arms positioned on respective sides thereof for rotation between a release position, in which said first and second connector housings are separated from each other, and a locked position in which said first and second connector housings are connected together with the first terminal elements electrically completely connected with the second terminal elements;

a shaped cam means defined in a free end portion of each of the arms and cooperable with the corresponding engagement pin member, said shaped cam means being of a generally arcuate shape having a center of curvature which is located offset from the axis of rotation of the lock handle whereby, as the lock handle is rotated from the release position towards the locked position after the first and second connector housings have been aligned with each other, the corresponding engagement pin member is guided along the shaped cam means allowing the first connector housing to be drawn relative to and close towards the second connector housing thereby to accomplish a complete electric connection between the first and second terminal elements upon arrival of the lock handle at the locked position; and each of said engagement pin members having a friction-reducing element to facilitate a relative movement of the respective engagement pin member along the shaped cam means during the rotation of the lock handle between the release and locked positions;

wherein said shaped cam means comprises a generally arcuate guide groove defined in the free end portion of each of the arms of the lock handle and having leading and trailing ends with respect to the direction of rotation of the lock handle from the release position towards the locked position and, said arcuate guide slot being delimited by long and short cam edges opposite to and spaced a predetermined distance from each other and between the leading and trailing ends, wherein an area of the free end of each arm adjacent the leading end of the arcuate guide slot has a straight guide groove defined therein for receipt of and guiding the associated engagement pin member into the leading end of the arcuate guide groove when the first and second connector housings are brought into abutment with each other while the lock handle is held in the release position and wherein said arcuate guide groove is of a generally T-shaped cross-sectional shape and wherein each of said engagement pin members comprises a shank portion connected at one end to the first connector housing and the opposite end formed with a radially outwardly extending head so as to represent a generally T-shaped configuration complemental to the cross-sectional shape of the arcuate guide groove.

6. The connector assembly as claimed in claim 1, wherein said shaped cam means comprises a generally arcuate guide slot defined in the free end portion of each of the arms of the lock handle and having leading and trailing ends with respect to the direction of rotation of the lock handle from the release position towards the locked position and, said arcuate guide slot being delimited by long and short cam edges opposite to and spaced a predetermined distance from each other and between the leading and trailing ends, and wherein an area of the free end of each arm adjacent the leading end of the arcuate guide slot has a straight guide slot defined therein for receipt of and guiding the associated engagement pin member into the leading end of the arcuate guide slot when the first and second connector housings are brought into abutment with each other while the lock handle is held in the release position.

7. The connector assembly as claimed in claim 6, wherein each of said engagement pin members is rotatably carried by the first connector housing.

8. The connector assembly as claimed in claim 6, wherein each of said engagement pin members comprises a shank portion connected at one end to the first connector housing and the opposite end formed with a radially outwardly extending head and wherein said friction-reducing element comprises a generally tubular member rotatably mounted on the shank of the respective engagement pin member.

9. The connector assembly as claimed in claim 6, wherein each of said engagement pin members comprises a shank portion connected at one end to the first connector housing and the opposite end formed with a radially outwardly extending head so as to have a diameter greater than the predetermined distance between the long and short cam edges.

* * * * *